US009677229B2

(12) United States Patent
Edwards, Jr. et al.

(10) Patent No.: US 9,677,229 B2
(45) Date of Patent: Jun. 13, 2017

(54) METHODS OF MANUFACTURING LOAD-SUPPORTING MATS FOR USE WITH INTERFACING GAP SEAL MEMBERS

(71) Applicant: NEWPARK MATS & INTEGRATED SERVICES LLC, The Woodlands, TX (US)

(72) Inventors: Richard Lamar Edwards, Jr., Lafayette, LA (US); Randy Paul Bordelon, Opelousas, LA (US); James Kerwin McDowell, Lafayette, LA (US)

(73) Assignee: Newpark Mats & Integrated Services LLC, The Woodlands, TX (US)

( * ) Notice: Subject to any disclaimer, the term of this patent is extended or adjusted under 35 U.S.C. 154(b) by 0 days.

(21) Appl. No.: 15/224,576

(22) Filed: Jul. 31, 2016

(65) Prior Publication Data

US 2016/0355996 A1 Dec. 8, 2016

Related U.S. Application Data

(63) Continuation of application No. 14/733,324, filed on Jun. 8, 2015, now Pat. No. 9,404,227.

(Continued)

(51) Int. Cl.

*E01C 11/24* (2006.01)
*E01C 5/00* (2006.01)

(Continued)

(52) U.S. Cl.

CPC ..... *E01C 11/24* (2013.01); *B65D 90/24* (2013.01); *E01C 5/001* (2013.01); *E01C 5/003* (2013.01);

(Continued)

(58) Field of Classification Search

CPC ... E01C 5/005; E01C 5/00; E01C 5/06; E01C 5/003; E01C 5/20; E01C 15/00;

(Continued)

(56) References Cited

U.S. PATENT DOCUMENTS 3,205,629 A * 9/1965 Rumley ..... E04B 1/6812 404/40
3,411,260 A 11/1968 Dill (Continued)

FOREIGN PATENT DOCUMENTS

DE 1251933 10/1967
DE 8531020 U1 2/1986

(Continued)

OTHER PUBLICATIONS

"DURA-BASE Composite Mat System", Newpark Mats & Integrated Services, 8 pp.

*Primary Examiner* — Abigail A Risic
(74) *Attorney, Agent, or Firm* — E. Randall Smith; E. Randall Smith, PC

(57) ABSTRACT

Methods of manufacturing a plurality of mats useful with a plurality of frame style seal members in a load-supporting surface include at least one milling machine, router or pre-formed mold forming at least first and second elongated grooves in first and second offset outer edges of at least a first side of each among at least first and second stepped-configuration, reversible mats. Each groove causes the seal member(s) seated therein to extend into a gap formed between the mats, abut at least one seal member extending from another mat into the same gap and form a liquid-tight seal therewith.

2 Claims, 15 Drawing Sheets

Related U.S. Application Data

(60) Provisional application No. 62/011,805, filed on Jun. 13, 2014, provisional application No. 62/116,989, filed on Feb. 17, 2015.

(51) Int. Cl.

| | |
|---|---|
| ***E01C 9/08*** | (2006.01) |
| ***E01C 11/02*** | (2006.01) |
| ***E02D 31/00*** | (2006.01) |
| ***E01C 9/00*** | (2006.01) |
| ***B65D 90/24*** | (2006.01) |

(52) U.S. Cl.
CPC ..... *E01C 5/005* (2013.01); *E01C 5/006* (2013.01); *E01C 9/00* (2013.01); *E01C 9/086* (2013.01); *E01C 11/02* (2013.01); *E02D 31/002* (2013.01); *E01C 2201/12* (2013.01)

(58) Field of Classification Search
CPC ..... E01C 2201/14; E01C 2201/06; E01C 2201/12; E01C 3/006; E01C 13/04; E01C 9/086; E01C 11/02; E04F 13/147; E04F 2201/09; E02D 31/002; B65D 90/24; F16J 15/10; F16J 15/021; F16J 15/027; F16J 15/025
See application file for complete search history.

(56) References Cited

U.S. PATENT DOCUMENTS

| | | | | |
|---|---|---|---|---|
| 3,521,528 | A | 7/1970 | Wangerow | |
| 3,732,788 | A | 5/1973 | Brown | |
| 4,195,850 | A * | 4/1980 | Berger | E04B 1/6812 277/650 |
| 4,362,427 | A | 12/1982 | Mass et al. | |
| 4,461,131 | A * | 7/1984 | Pressell | E04F 15/02 52/395 |
| 4,522,413 | A | 6/1985 | Nicholas | |
| 4,708,517 | A | 11/1987 | Nicholas et al. | |
| 4,743,036 | A | 5/1988 | Nicholas | |
| 4,824,289 | A * | 4/1989 | Glang | E21D 11/385 277/626 |
| 5,653,551 | A | 8/1997 | Seaux | |
| 5,900,203 | A | 5/1999 | Needham et al. | |
| 6,511,257 | B1 | 1/2003 | Seaux et al. | |
| 6,649,110 | B1 | 11/2003 | Seaux et al. | |
| 6,695,527 | B2 | 2/2004 | Seaux et al. | |
| 6,722,831 | B2 * | 4/2004 | Rogers | F16B 21/02 411/345 |
| 7,413,374 | B2 | 8/2008 | Rogers et al. | |
| 8,978,334 | B2 * | 3/2015 | Engstrom | E04F 15/02 52/391 |
| 9,222,358 | B2 * | 12/2015 | Hoeft | E21D 11/385 |
| 2002/0170259 | A1 * | 11/2002 | Ferris | E01C 5/00 52/596 |
| 2004/0228684 | A1 * | 11/2004 | Lombardo | E01C 5/005 404/41 |
| 2008/0083182 | A1 * | 4/2008 | Fletcher | E01C 5/005 52/403.1 |
| 2008/0245014 | A1 | 10/2008 | Carter | |
| 2013/0264773 | A1 * | 10/2013 | McDowell | F16J 15/10 277/312 |
| 2013/0326966 | A1 * | 12/2013 | Willems | E01C 5/22 52/125.4 |
| 2015/0184384 | A1 * | 7/2015 | Willems | E04C 2/049 428/312.4 |
| 2015/0276060 | A1 * | 10/2015 | McGrath | F16J 15/027 277/642 |

FOREIGN PATENT DOCUMENTS

| | | | |
|---|---|---|---|
| EP | 1762670 | A1 | 12/2005 |
| GB | 1536684 | | 12/1978 |
| WO | 2005/040523 | A1 | 5/2005 |

* cited by examiner

METHODS OF MANUFACTURING LOAD-SUPPORTING MATS FOR USE WITH INTERFACING GAP SEAL MEMBERS

CROSS REFERENCE TO RELATED APPLICATIONS

The present application is a continuation application of and claims priority to U.S. patent application Ser. No. 14/733,324, filed on Jun. 8, 2015 and entitled "Load-Supporting Surface with Interfacing Gap Seal Members and Related Apparatus & Methods", which claims priority to U.S. Provisional Patent Application Ser. Nos. 62/011,805, filed on Jun. 13, 2014 and entitled "Load-Supporting Surface with Interconnecting Components and Frame style Seal Assembly for Sealing Therebetween and Methods of Assembly and use Thereof" and 62/116,989, filed on Feb. 17, 2015 and entitled "Load-Supporting Surface with Interconnecting Components and Frame style Seal Assembly for Sealing Therebetween and Methods of Assembly and use Thereof", all of which are hereby incorporated by reference herein in their entireties.

FIELD OF THE DISCLOSURE

The present disclosure relates generally to preventing the leakage of liquid from a load-supporting surface and, more particularly, to forming a seal between adjacent components of a load-supporting surface.

BACKGROUND

Temporary or semi-permanent support surfaces have been used for roadways, remote jobsites, industrial staging areas and the like in an ever-increasing myriad of industries, such as the construction, military, oilfield, transportation, disaster response, utilities and entertainment industries. These support surfaces are often made up of multiple components, such as heavy duty mats, which are reusable and interlock together to form the support surface.

In many instances, gaps are formed between the interconnected components of the support surface. Liquid that is spilled or otherwise introduced onto the support surface may seep through these gaps and into the earth or subgrade terrain. This presents various potential problems, including environmental and safety concerns and waste disposal challenges, and can lead to significant expense and effort for remediation, delay of operations, additional manpower and equipment for cleanup, etc.

For example, in many instances, plastic liners are placed below and around the support surface in an effort to capture liquids that are spilled or otherwise introduced onto the support surface before such liquids encounter the subgrade terrain. The use of liners with temporary or semi-permanent support surfaces may have one or more disadvantages. For example, discarding the liners can sometimes be problematic because landfill operators have expressed disinterest in accepting used liners on the basis that they are bulky and require excessive landfill space, or for other reasons. For another example, the plastic liners are sometimes ineffective at preventing liquid leakage from the support surface or allowing effective clean-up, which can cause other problems and require significant time and effort.

Thus, there is a need for improved apparatus, systems and methods for preventing liquids spilled or otherwise introduced onto a load-supporting surface from leaking through gaps formed between adjacent mats or other components.

It should be understood that the above-described features, capabilities and disadvantages are provided for illustrative purposes only and are not intended to limit the scope or subject matter of the appended claims or those of any related patent application or patent. Thus, none of the appended claims or claims of any related application or patent should be limited by the above discussion or construed to address, include or exclude each or any of the above-cited features, capabilities or disadvantages merely because of the mention thereof herein. For example, the above discussion involving the potentially disadvantageous use of "liners" should not be construed to mean that liners cannot be used with any one or more of the features or embodiments of the present disclosure discussed below or shown in the appended drawings (e.g. seal assembly 10), unless and only to the extent as may be explicitly provided in a particular claim and only with respect to such claim and any claims depending therefrom.

Accordingly, there exists a need for improved systems, articles and methods useful in connection with containing liquids introduced onto a load-supporting surface having one or more of the attributes or capabilities described or shown in, or as may be apparent from, the other portions of this patent.

BRIEF SUMMARY OF THE DISCLOSURE

In some embodiments, the present disclosure involves methods of manufacturing a plurality of mats useful with a plurality of frame style seal members in a load-supporting surface. Each frame style seal member has front and rear portions and is configured to be coupled to one of the mats and provide a liquid-tight seal across a gap formed between adjacent mats in the load-supporting surface. These methods includes at least one milling machine or router forming a first elongated groove in a first outer edge of at least a first side of each among at least first and second stepped-configuration, reversible mats. The first outer edge of each mat extends at least partially around a first perimeter of the mat. The first elongated groove of each mat is configured to seat the rear portion of at least one frame style seal member. At least one milling machine or router forms a second elongated groove in a second outer edge of at least the first side of at least the first and second mats. The second outer edge of each mat extends at least partially around a second perimeter of the mat. The first and second outer edges of each mat are offset relative to one another depth-wise so that the first outer edge is disposed above and outwards of the second outer edge of each mat when the mat is right-side-up. The second elongated groove of each mat is configured to seat the rear portion of at least one other frame style seal member. Each among the first and second grooves of at least the first side of at least first and second mats causes the respective front portion of the frame style seal member(s) seated therein to extend into a respective gap formed between the first and second mats when the first and second mats are positioned adjacent to one another in the load-supporting surface with the first mat right-side-up and the second mat upside-down, abut at least one frame style seal seated in the first or second groove of the first side of the adjacent mat and form a liquid-tight seal therewith across the corresponding gap.

In various embodiments, the present disclosure involves methods of manufacturing a plurality of mats useful with a plurality of frame style seal members in a load-supporting surface. Each frame style seal member has front and rear portions and is configured to be coupled to one of the mats and provide a liquid-tight seal across a gap formed between adjacent mats in the load-supporting surface. These methods includes at least one pre-formed mold forming a first elongated groove in a first outer edge of at least a first side of each among at least first and second stepped-configuration, reversible mats. The first outer edge of each mat extends at least partially around a first perimeter of the mat. The first elongated groove of each mat is configured to seat the rear portion of at least one frame style seal member. At least one pre-formed mold forms a second elongated groove in a second outer edge of at least the first side of at least the first and second mats. The second outer edge of each mat extends at least partially around a second perimeter of the mat. The first and second outer edges of each mat are offset relative to one another depth-wise so that the first outer edge is disposed above and outwards of the second outer edge of each mat when the mat is right-side-up. The second elongated groove of each mat is configured to seat the rear portion of at least one other frame style seal member. Each among the first and second grooves of at least the first side of at least first and second mats causes the respective front portion of the frame style seal member(s) seated therein to extend into a respective gap formed between the first and second mats when the first and second mats are positioned adjacent to one another in the load-supporting surface with the first mat right-side-up and the second mat upside-down, abut at least one frame style seal seated in the first or second groove of the first side of the adjacent mat and form a liquid-tight seal therewith across the corresponding gap.

Accordingly, the present disclosure includes features and advantages which are believed to enable it to advance load-support surface technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PRESENTLY PREFERRED EMBODIMENTS

Figure 1:
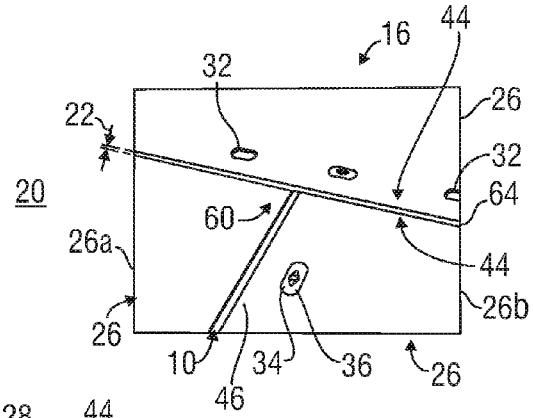
FIG. 1 is a top view of an exemplary load-supporting surface having seal members secured between adjacent interconnected mats in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring initially to FIG. 1, an exemplary elongated frame style seal assembly 10 useful for preventing the leakage of liquid through at least one gap 22 formed between adjacent mats 26 in a load-supporting surface 16 onto the ground 20 or other surface or area below the load-supporting surface is shown. In this example, the load-supporting surface 16 is reusable and may be capable of supporting the weight of vehicles, equipment and/or other structures thereupon. The illustrated load-supporting surface 16 includes at least at least two interconnected adjacent mats 26.

Figure 2:
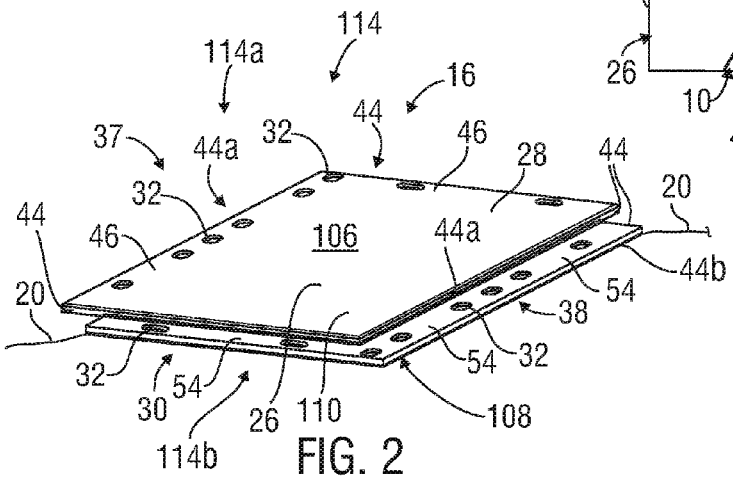
FIG. 2 is a perspective view of an exemplary mat used in the exemplary load-supporting surface of FIG. 1.

Referring to FIG. 2, the mats 26 may have any suitable form, construction and configuration. Some examples of mats 26 which may be used in various embodiments of the present disclosure are shown and described in U.S. Pat. No. 6,722,831 to Rogers et al, entitled "Fastening Device" and issued on Apr. 20, 2004, U.S. Provisional Patent Application Ser. No. 61/748,818, entitled "Apparatus and Methods for Connecting Mats" and filed on Jan. 14, 2013, and U.S. patent application Ser. No. 13/780,350, entitled "Apparatus and Methods for Connecting Mats" and filed on Feb. 28, 2013, all of which have a common Assignee as the present patent application and the entire contents of which are hereby incorporated by reference herein in their entireties. Each exemplary mat 26 may, in some instances, weight approximately 1,000 lbs., be heavy duty, durable, all-weather, reusable or designed to withstand 600 psi in pure crush pressure placed thereupon and capable of reducing point-to-point ground pressure on the ground 20 or other surface or area below the mat 26 caused by wheeled and/or tracked vehicles on the mat 26, or any combination thereof. For example, the mats 26 may be 14'×8' DURA-BASE® mats currently sold by the Assignee of this patent application.

Still referring to FIG. 2, in the illustrated embodiment, each mat 26 is flat, or planar, has a stepped-configuration and is constructed of impermeable material, such as thermoplastic. As used herein, the term "stepped-configuration" means the mat 26 has at least one portion that extends at least partially on a different plane than at least one other portion and the planes are at least substantially parallel.

Figure 15B:
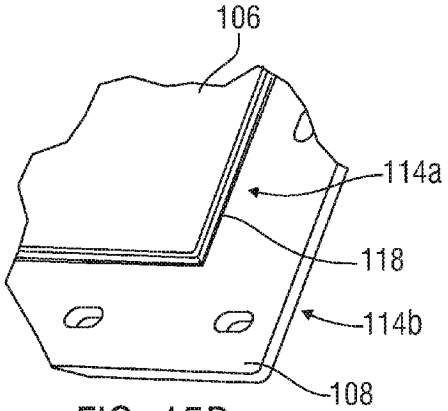
FIG. 15B is an exploded view of part of the exemplary mat of FIG. 15A taken from inside the circle in FIG. 15A labeled "FIG. 15B"
Figure 15A:
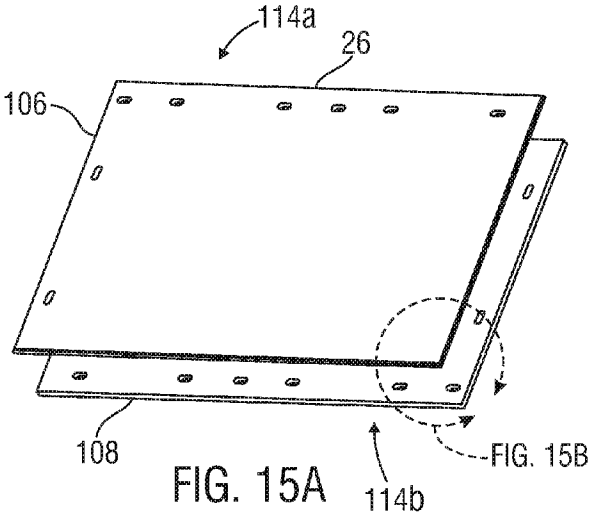
FIG. 15A is a perspective view of an exemplary mat of the type shown in FIG. 2 and an embodiment of a frame style seal member engaged therewith in accordance with an embodiment of the present disclosure.

The exemplary mat 26 has a rectangular shape with an opposing pair of short sides 28, 30, an opposing pair of long sides 37, 38, and at least one edge 44 (e.g. edge 44*a*) extending along each side 28, 30, 37 and 38 and around a perimeter 114 (e.g. perimeter 114*a*) of the mat 26. In this particular example, the mat 26 is constructed of upper and lower engaged offset panels 106, 108 and is reversible. In other words, the top and bottom of the illustrated mat 26 are mirror images of one another, so either the top or bottom can be facing up or down and interconnected with other components of a load-supporting surface 16. The illustrated mat 26 thus has a first, upper, set of aligned edges 44*a* extending around an "upper" perimeter 114*a* (formed around the upper panel 106), and a second, lower, set of aligned edges 44*b* extending around a "lower" perimeter 114*b* (formed around the lower panel 108) (see also e.g. FIGS. 15A-B). However, in other embodiments, the mat 26 may be a single unitary item or a combination of more than two component parts, may not be reversible, may have only one, or more than two, perimeters 114, may have a square shape, or have five, six, seven or more sides, or a combination thereof.

In this example, the first short side 28 and first long side 37 each have an upper lip 46 extending horizontally outwardly therefrom, which will be typically be spaced above the ground 20 or other surface. The illustrated second short side 30 and second long side 38 each have a lower lip 54 extending horizontally outwardly therefrom, and which will typically rest on the ground 20 or other surface. Thus, in this embodiment, two sets of aligned edges 44*a*, 44*b* are formed around the sides 28, 30, 37 and 38.

The upper and lower lips 46, 54 may have any suitable size, shape, configuration and length. Still referring to FIG. 2, in this example, the respective upper and lower lips 46, 54 of different mats 26 are interconnectable with locking pins 34 (e.g. FIG. 1) releasably securable through corresponding locking pin holes 32 formed therein. The locking pin holes 32 and locking pins 34 may have any suitable form, construction and configuration. In this embodiment, the illustrated mats 26 include a plurality of locking pin holes 32, each configured to accept a releasable locking pin 34 (FIG. 1) therethrough. Each illustrated mat 26 may include, for example, a total of sixteen locking pin holes 32, eight holes 32 formed in each of the upper and lower lips 46, 54. In some embodiments, the locking pins 34 may form a liquid-tight seal around, or in, the locking pin holes 32 within which they are engaged. Some examples of locking pins 34 which may be used in various embodiments of the present disclosure are shown and described in U.S. Pat. No. 6,722,831 to Rogers et al, entitled "Fastening Device" and issued on Apr. 20, 2004, U.S. Provisional Patent Application Ser. No. 61/748,818, entitled "Apparatus and Methods for Connecting Mats" and filed on Jan. 14, 2013, and U.S. patent application Ser. No. 13/780,350, entitled "Apparatus and Methods for Connecting Mats" and filed on Feb. 28, 2013, all of which have a common Assignee as the present patent application and the entire contents of which are hereby incorporated by reference herein in their entireties.

In the illustrated example, the locking pin holes 32 of the mats 26 have an oval-shape to accept an oval-shaped enlarged head 36 (e.g. FIG. 1) of the illustrated locking pins 34. It should be noted, however, that the frame style seal assembly 10 of the present disclosure is not limited to use with the above-described or referenced types and configurations of load-supporting surfaces 16, mats 26, locking pins 34 and locking pin holes 32, or to the disclosures of the above-referenced patents and patent applications. Any suitable load-supporting surfaces 16, mats 26, locking pins 34 and locking pin holes 32 may be used. For example, some embodiments of the seal assembly 10 may be used with mats 26 not having upper and/or lower lips 46, 54. Moreover, the seal assembly 10 may be used with load-supporting surfaces not having mats, locking pins or locking pin holes. Thus, the seal assembly 10 of the present disclosure may be used with any type of load-supporting surface having any desired components and is not limited thereby, unless and only to the extent as may be explicitly required in a particular claim hereof and only for such claim and any claims depending therefrom.

Figure 3:
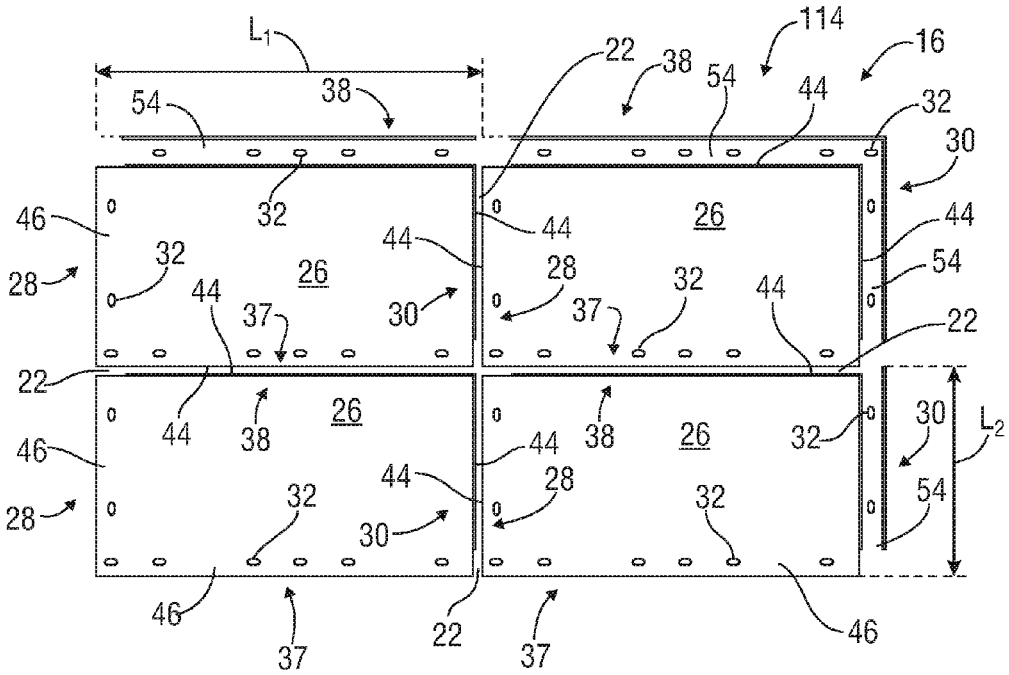
FIG. 3 is a top view of an exemplary load-supporting surface having four interconnected mats of the type shown in FIG. 2.
Figure 4:
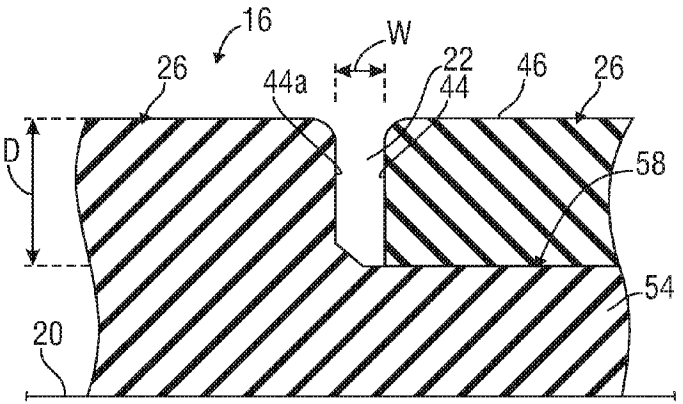
FIG. 4 is a cross-sectional view of two adjacent interconnected mats of the type shown in FIG. 2.

Referring to FIGS. 3 and 4, in the illustrated exemplary load-supporting surface 16, the gaps 22 are formed between adjacent edges 44 of adjacent respective sides of each pair of interconnected mats 26. Each illustrated gap 22 has a width W, depth D and length $L_1$ or $L_2$ and is in fluid communication with a horizontally-extending interface 58 (e.g. FIG. 4) formed between the adjacent upper and lower lips 46, 54 of the adjacent mats 26. The illustrated interface 58 is in fluid communication with the ground 20 or other surface or area beneath the load-supporting surface 16. Thus, in this example, liquid that enters the gap 22 may seep or flow into the interface 58 between the mats 26 and then onto the ground 20 (or other surface or area) below the load-supporting surface 16.

Figure 5A:
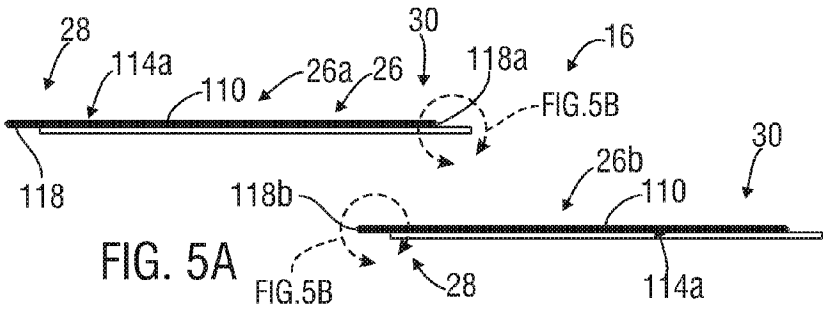
FIG. 5A is a side view of two exemplary mats of the type shown in FIG. 2 and having components of an exemplary frame style seal assembly in accordance with an embodiment of the present disclosure.
Figure 14A:
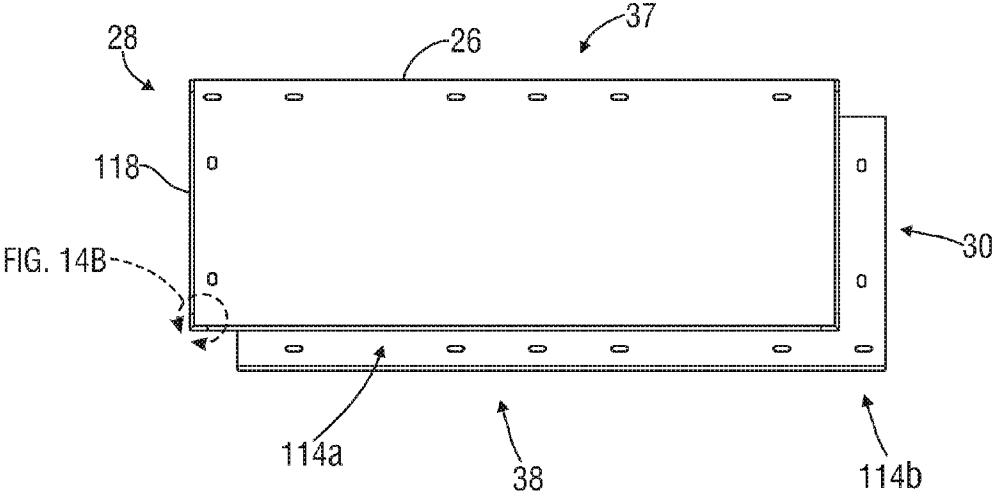
FIG. 14A is a top view of an exemplary mat of the type shown in FIG. 2 and components of an exemplary frame style seal assembly in accordance with an embodiment of the present disclosure.
Figure 14C:
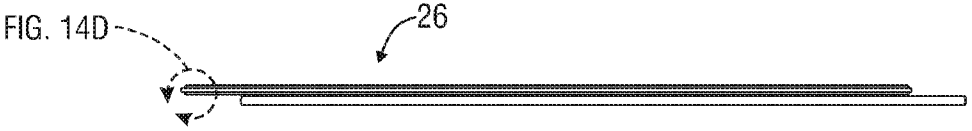
FIG. 14C is a side view of the exemplary mat and frame style seal assembly components of FIG. 14A.
Figure 14D:
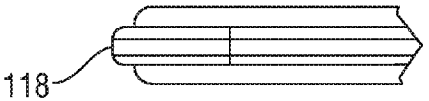
FIG. 14D is an exploded view of part of the exemplary mat of FIG. 14C taken from inside the circle in FIG. 14C labeled "FIG. 14D"
Figure 14B:
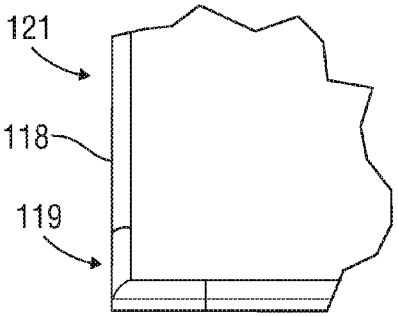
FIG. 14B is an exploded view of part of the exemplary mat of FIG. 14A taken from inside the circle in FIG. 14A labeled "FIG. 14B" and showing exemplary linear and corner sections of the illustrated frame style seal member in accordance with an embodiment of the present disclosure.

Now referring to FIGS. 5A-B, the frame style seal assembly 10 is configured to provide a liquid-tight seal across, or through, at least one gap 22 formed between adjacent mats 26 to prevent liquid introduced onto the load-supporting surface 16 from entering the one or more gaps 22, from flowing from one or more gaps 22 into the interface 58 or another gap 22, from flowing from the interface 58 and/or one or more gaps 22 onto the ground 20 (or other surface or area below the load-supporting surface 16) or a combination thereof. The frame style seal assembly 10 may have any suitable form, configuration and operation. For example, the seal assembly 10 may include a distinct elongated, liquid-impermeable seal member 118 extending from each adjacent mat 26 into, across, or through one or more gaps 22 and into sealing engagement with one or more other such seal members 118 or other components. As used herein, the term "elongated" means a component having a length that is greater than any of its other dimensions. In some instances, components described herein as "elongated" may have a length that is similar to the length of a side 28, 30, 37 or 38 (e.g. FIGS. 2 & 14A) of a mat 26. Various views of exemplary frame style seal assemblies 10, seal members 118, mats 26 and load-supporting surfaces 16 are shown in FIGS. 5A-21C.

Figure 5B:
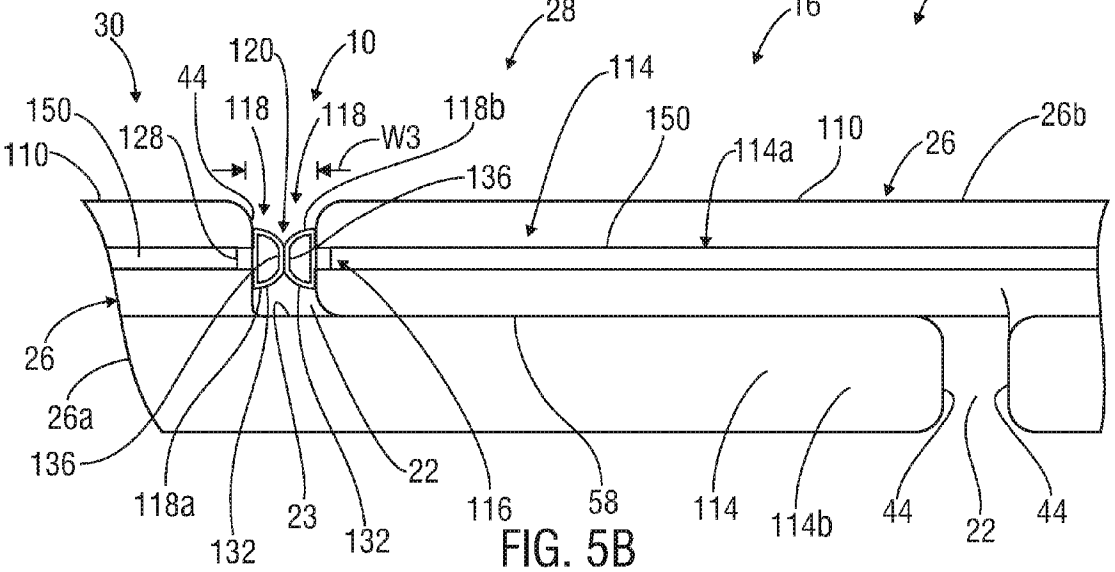
FIG. 5B is an exploded view of the exemplary mats and frame style seal assembly components of FIG. 5A taken from inside the circles in FIG. 5A labeled "FIG. 5B" and joined together.
Figure 6A:
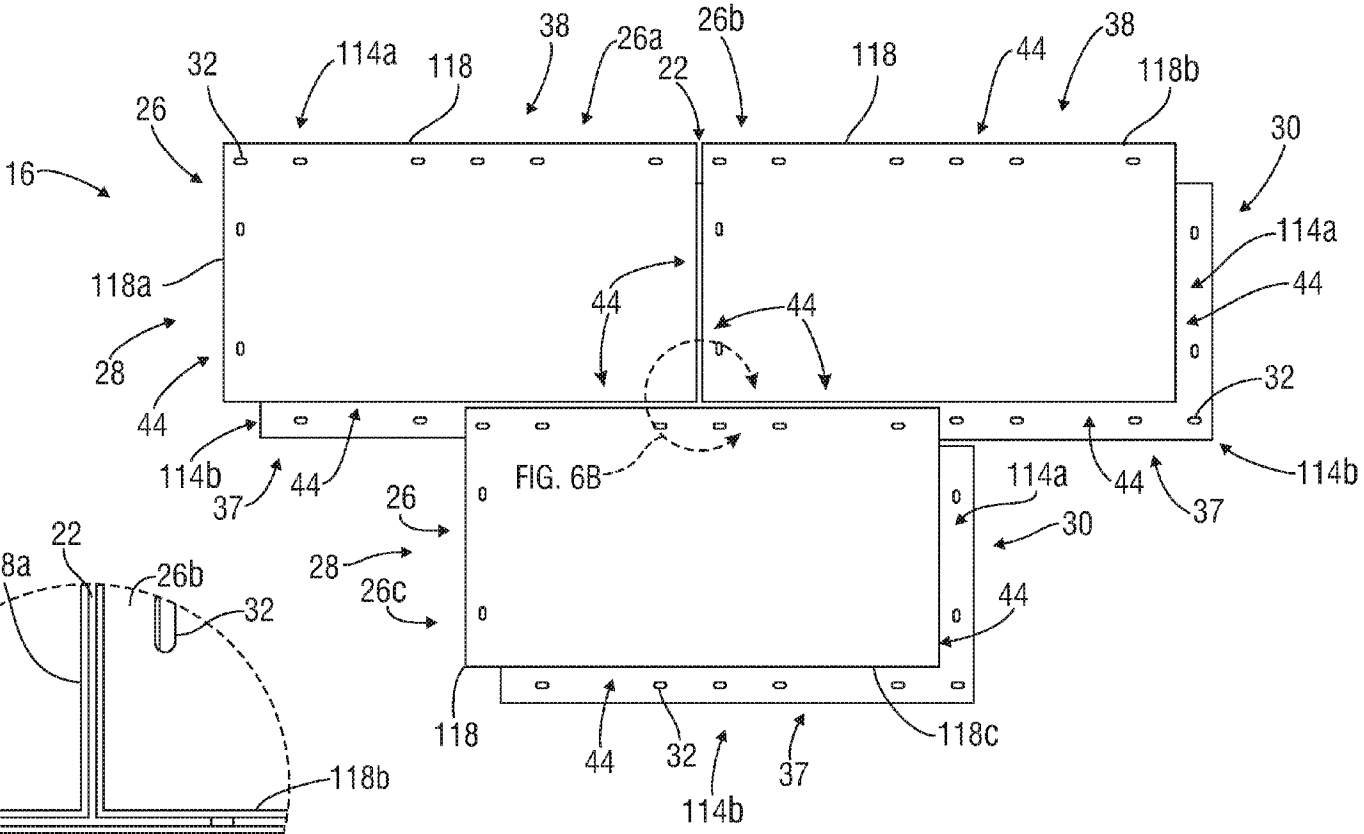
FIG. 6A is a top view of three exemplary mats of the type shown in FIG. 2 and components of an exemplary frame style seal assembly in accordance with an embodiment of the present disclosure.
Figure 6B:
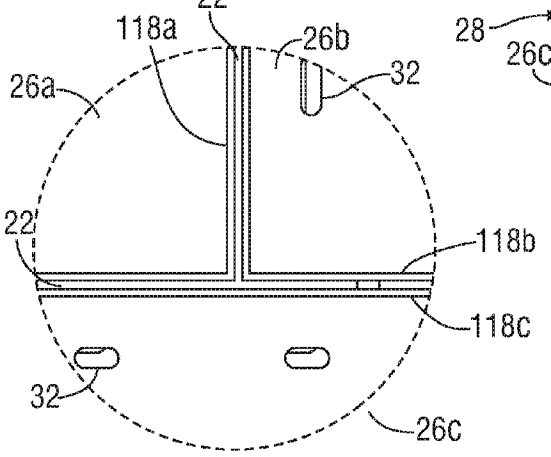
FIG. 6B is an exploded view the exemplary mats of FIG. 6A taken from inside the circle in FIG. 6A labeled "FIG. 6B" and positioned to be joined together.

Referring specifically to FIG. 5B, in the illustrated embodiment, the frame style seal assembly 10 includes a first elongated seal member 118*a* coupled to and sealingly engaged with a first mat 26*a* and extending laterally outwardly therefrom. A second elongated seal member 118*b* is similarly coupled to, sealingly engaged with and extending outwardly from a second mat 26*b* (see also FIGS. 12A-B). Each exemplary seal member 118 is thus actively coupled to and sealing engaged with a different mat 26. As used herein in describing the relationship of a seal member 118 and a mat 26 or other component, the terms "coupled", "connected" and variations thereof mean connected, tied or integrated together in any suitable manner that ensures the seal member 118 remains with the mat 26 during normal or expected operating conditions and use of the load-supporting surface 16. In some embodiments, "coupled" could include integral formation of the seal member 118 and mat 26, such as by being formed or molded together. In other embodiments, "coupled" is an impermanent connection (e.g. mechanically connected, friction, tension or snap fit, elastically-biased, mateably connected, bolted, clipped, etc.), or a semi-permanent connection (e.g. with the use of heavy duty adhesive, heat-activated glue, etc.), of the seal member 118 and mat 26 or other component. It should be noted, however, in some embodiments, the seal member 118 is removable from the mat 26.

When the mats 26*a*, 26*b* are interconnected in the load-supporting surface 16, the exemplary seal members 118*a*, 118*b*, extends into a gap 22 and sealingly engage one another. Fluid, or liquid tight sealing engagement occurs in this embodiment at (i) one or more interfaces 116 between each seal member 118*a*, 118*b* and its corresponding adjacent mat 26 and (ii) one or more interfaces 120 formed between the seal members 118*a*, 118*b*. The illustrated frame style seal assembly 10 thus includes seal members 118*a*, 118*b* that form a seal across, or through, the illustrated gap 22 between the respective upper surfaces 110 of adjacent mats 26, effectively serving as an intermediate upper surface between the adjacent mats 26 to retain liquid on the top side 16*a* of the load-supporting surface 16.

Still referring to the embodiment of FIG. 5B, while the seal members 118 sealingly engage each other to form a seal across, over or through the gap 22, they may or may not completely fill the entire gap 22. In the present embodiment, the seal members 118 each extend into and across the gap 22, but do not entirely fill the gap 22. In other embodiments, the seal members 118 may together entirely fill the gap 22. Further, the seal members 118 of this embodiment may or may not align with the upper surfaces 110 of the adjacent mats 26. For example, the illustrated seal members 118 extend across the gap 22 at a height below the height of the upper surfaces 110 of the mats 26 and above the lower surface 23 of the gap 22. In other embodiments, one or both seal members 118, or other components of the seal assembly 10, may sit flush with or, at the same height of, the upper surface 110 of one or more mats 26 (or other component(s) of the load-supporting surface 16) or abut the lower surface 23 of the gap 22. These configurations could be beneficial in at least some applications to prevent the seal members 118 from becoming damaged, crushed or displaced due to movement or placement of vehicles, equipment, personnel or other items on the load-supporting surface 16. In other applications, it may be desirable for the seal members 118 to extend above the height of the upper surface 110 of one or more mats 26 or other component(s) of the load-supporting surface 16.

The frame style seal assembly 10 may include any desired number of seal members 118. For example, referring to the embodiment of FIGS. 6A-B, a single seal member 118 may extend entirely around a perimeter 114 (e.g. perimeter 114*a*) of its associated mat 26. In the illustrated embodiment, three mats 26*a*, 26*b* and 26*c* are show each having a single corresponding seal member 118*a*, 118*b*, 118*c* (see also e.g. FIGS. 12A-B). In each case, each seal member 118 extends around and couples to a set of aligned edges 44 of the sides 28, 30, 37 and 38 that extend around the perimeter 114*a* of its respective corresponding mat 26*a*, 26*b*, 26*c*. In other embodiments, multiple seal members 118 may be used to extend around a single perimeter 114 of the mat 26, or only a portion of one or more perimeters 114 of the mat 26.

In yet other embodiments, one or more seal members 118 may engage one or more other part of each mat 26 (other than perimeter 114*a*) to form the frame style seal assembly 10. For example, in some configurations, the seal member(s) 118 may not engage a perimeter 114 of the mat 26, but instead engage one or more area of the mat 26 proximate to a perimeter 114. Or one or more seal members 118 may engage both a perimeter 114 and another portion of the mat 26.

Figures 17A, 17B:
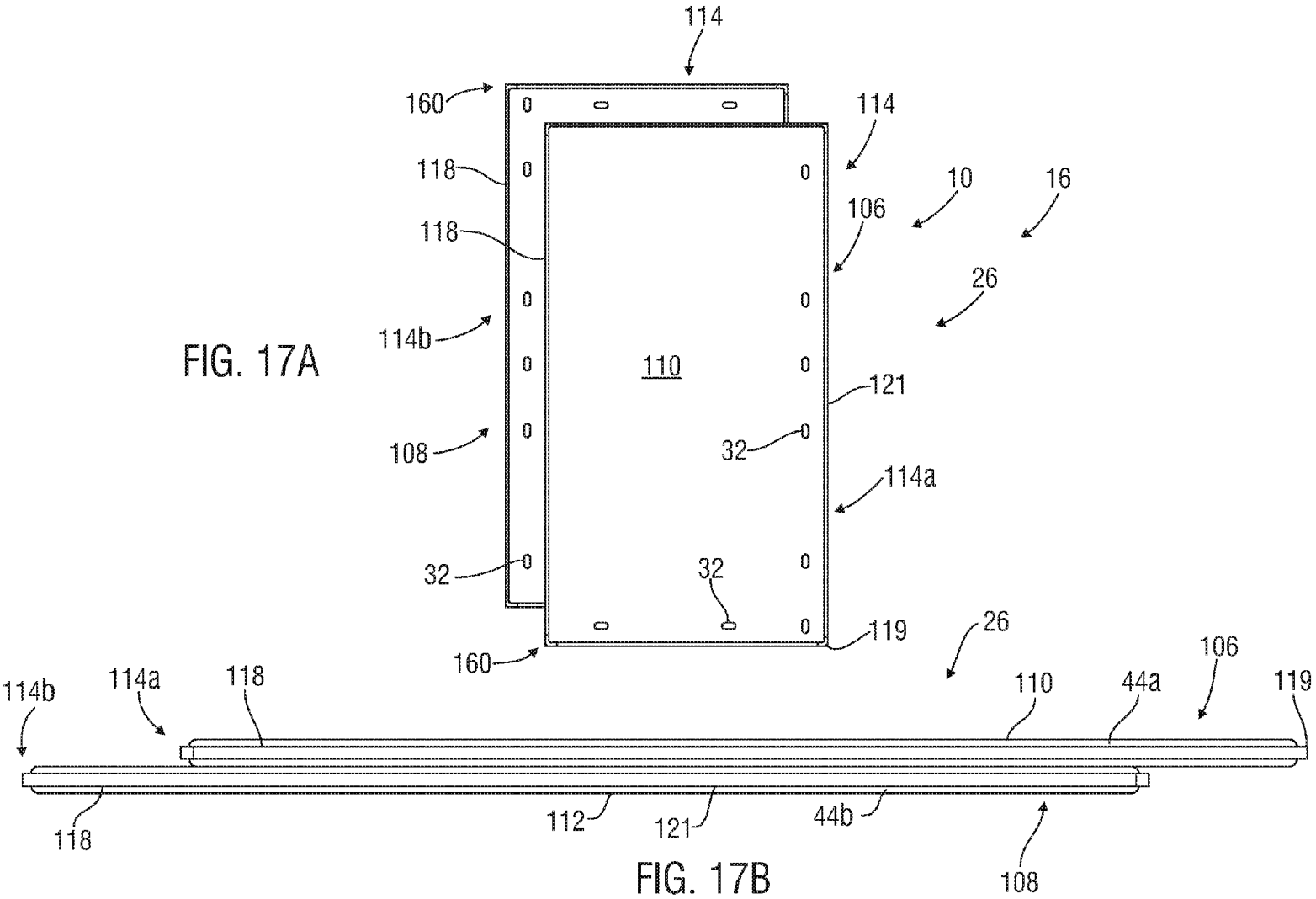
FIG. 17A is a top view of an exemplary mat having exemplary frame style seal members shown extending around first and second perimeters thereof in accordance with an embodiment of the present disclosure.
FIG. 17B is a side view of the exemplary mat and frame style seal members of FIG. 17A.

For another example, the seal member(s) 118 may extend around the lower perimeter 114*b* (formed around the lower panel 108) (e.g. FIGS. 17A-B). In such instance, all the details with respect to the seal member 118 described and shown herein as extending around the upper perimeter 114*a* apply equally to these embodiments and are incorporated by reference herein in their entireties. Some embodiments showing seal members 118 extending around the lower perimeter 114*b* are shown in FIGS. 17A-19B.

In still other embodiments, multiple seal members 118 (e.g. FIGS. 18A-B) may be associated with each mat 26 to form sealing redundancy between adjacent mats 26. This may be useful, for example, (i) to provide one or more back-up, or secondary, seals between adjacent mats 26 in case the primary seal (e.g. seal member 118 as described above) is compromised or leaks, (ii) to allow the mats 26 to effectively be reversible so that each mat 26 can be sealingly engaged to one or more other mats or components of a load-supporting surface 16 regardless of whether the upper surface 110 or lower surface 112 of each mat 26 is face up or face down, or (iii) for any other desired purpose. In the example of FIGS. 17A-B, the illustrated seal assembly 10 includes a distinct seal member 118 extending around each perimeter 114*a*, 114*b* of the illustrated mat 26. In this example, either the upper surface 110 or lower surface 112 of the mat 26 may be face up or face down.

Figure 18A:
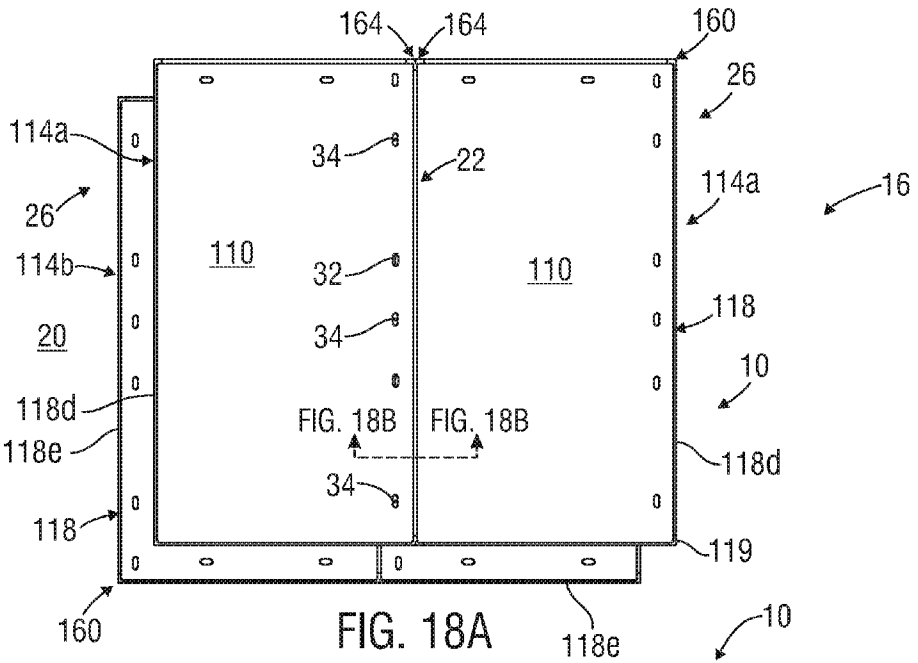
FIG. 18A is a top view of a pair of interconnected exemplary mats of the type shown in FIG. 2 each having exemplary frame style seal members shown extending around first and second perimeters thereof in accordance with an embodiment of the present disclosure.
Figure 18B:
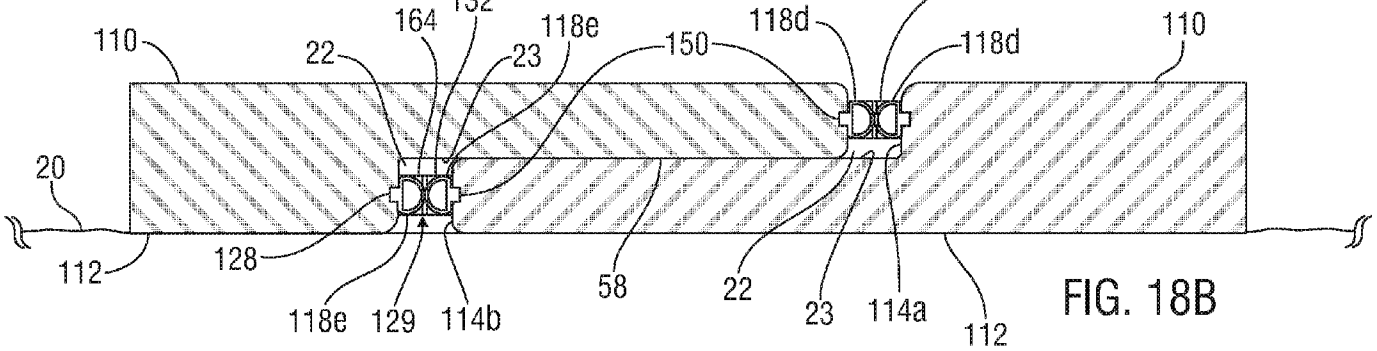
FIG. 18B is a cross-sectional view of the interconnected mats of FIG. 18A taken along lines FIG. 18B-FIG. 18B.

In the embodiment of FIGS. 18A-B, the seal assembly 10 includes a first seal member 118*d* extending around the upper perimeter 114*a* of each mat 26 and a second seal member 118*e* extending around the lower perimeters 114*b* thereof. The respective adjacent seal members 118*d*, 118*e* of the illustrated adjacent mats 26 have the same form, features, configuration and operation as the seal members 118 previously described and shown elsewhere (e.g. FIG. 5B) in this patent. However, since the exemplary seal member 118 previously described in this patent extends around the upper perimeter 114*a* of the corresponding mat 26 and is situated between the upper surface 110 of the mat 26 and the lower surface 23 of the corresponding gap 22 (as are seal members 118*d* in FIGS. 18A-B), it is apparent that the illustrated seal members 118*e* (which extend around the lower perimeters 114*b* of the corresponding mats 26) are shown situated between the lower surface 23 of the corresponding gap 22 and the lower surfaces 112 of the mats 26. In other embodiments, the seal members 118, or other components of the seal assembly 10, may sit flush with or, at the same level as, the lower surface 112 of one or more mats 26 (or other component(s) of the load-supporting surface 16) or abut the lower surface 23 of the corresponding gap 22.

Still referring to FIGS. 18A & B, the illustrated seal members 118*e* thus effectively serve as an intermediate lower surface between the adjacent mats 26 to prevent liquid from flowing from the associated gap 22 and interface 58 to the ground 20 or other underlying surface or area (unless, of course, the subject mats 26 have been flipped over). Further, the seal members 118*e* of this embodiment may or may not align with the lower surfaces 112 of the adjacent mats 26. For example, the illustrated seal members 118*e* extends across the gap 22 at a height between the lower surface 23 of the associated gap 22 and the adjacent lower surfaces 112 of the mats 26. Likewise, while the seal members 118*e* sealingly engage each other to form a seal across, over or through the corresponding gap 22, they may or may not completely fill the entire gap 22. In the present embodiment, the seal members 118*e* each extend into and across the gap 22, but do not entirely fill the gap 22. In other embodiments, the seal members 118*e* may together entirely fill the gap 22 or extend out of the gap 22.

The seal member 118 may have any suitable form, configuration and operation and may be coupled to a mat 26 in any suitable manner. Referring to the embodiment of FIGS. 7A-B, each seal member 118 may actively connect to and sealing engage a respective mat 26 in any suitable manner. In this embodiment, each seal member 118 includes a front portion, or top side, 122 and a rear portion, or bottom side 124 (see also FIG. 8A). The exemplary bottom side 124 actively connects to and sealing engages the corresponding mat 26. In this embodiment, the bottom side 124 engages an elongated groove 150 formed in the aligned edges 44 extending around the corresponding perimeter 114 of the mat 26 (see also e.g. FIGS. 13A-B). The groove 150 may have any suitable form, configuration and operation. Further, some embodiments include more than one groove 150 formed in each mat 26 or perimeter(s) 114 thereof.

Figure 7A:
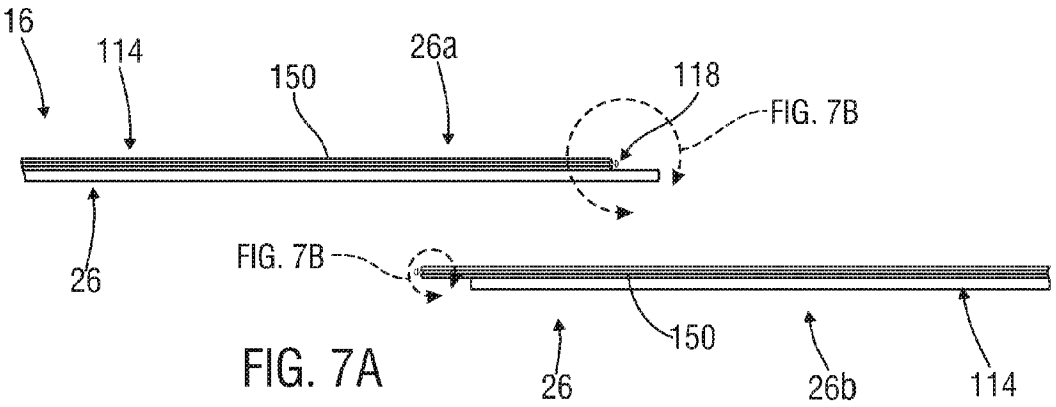
FIG. 7A is a side view of two exemplary mats of the type shown in FIG. 2 and components of an exemplary frame style seal assembly in accordance with an embodiment of the present disclosure.
Figure 7B:
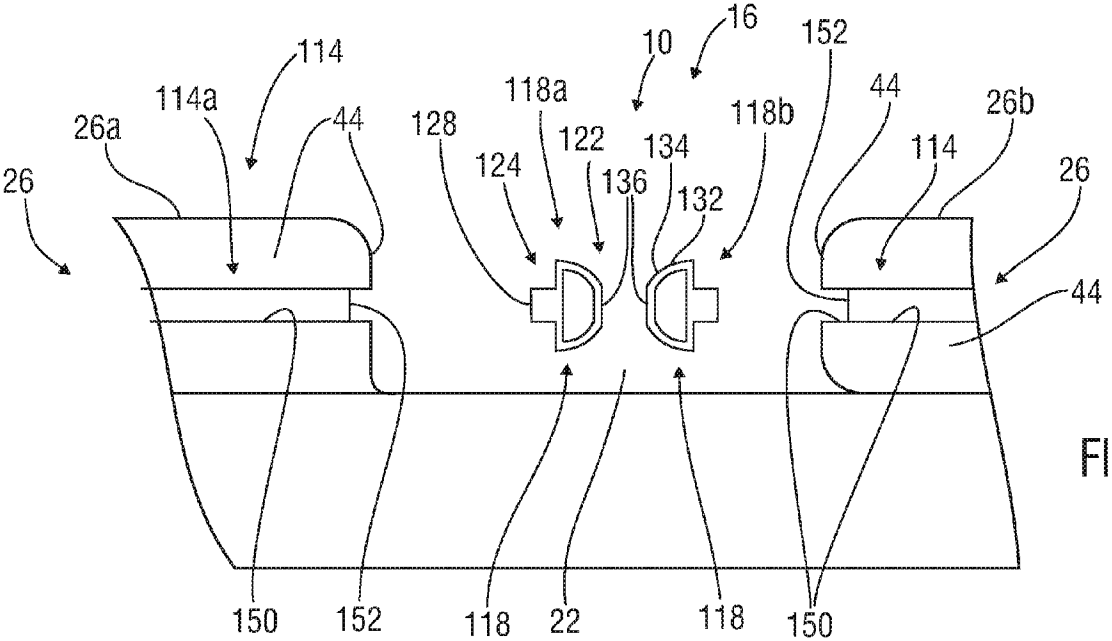
FIG. 7B is an exploded view of the exemplary mats and components of the frame style seal assembly of FIG. 7A taken from inside the circles in FIG. 7A labeled "FIG. 7B" and showing the mats positioned adjacent to one another.

Still referring to FIGS. 7A-B, the exemplary groove 150 extends into the aligned edges 44 extending around the mat's sides 28, 30, 37, 38 and around its corners 27 (e.g. FIGS. 9A & 9B) that span the corresponding perimeter 114 of the mat 26. For example, the groove 150 may be machined or integrally formed into each mat 26. In some embodiments, one or more router or milling machine, as is and becomes further known in the art, may be used to form the groove 150 into each mat 26. If desired, the router(s) and/or milling machine(s) may be robotic. In other embodiments, the grooves 150 may be integrally formed into the mats 26 during molding of the mats, such as with the use of pre-formed molds used in any desired mat molding process (e.g. thermoplastic compression, rotational or injection molding), as is and becomes further known in the art.

Referring specifically to FIG. 7B, the illustrated seal member 118 is constructed of elastic or stretchable material, such as rubber, and formed in the shape of a loop, or frame. This configuration is referred to herein as a "closed loop" configuration. In this embodiment, the length of the closed loop seal member 118 is smaller than the length of the perimeter 114 of the mat 26 (as measured at the base, or inside wall, 152 of the groove 150). In such instance, the seal member 118 may be stretched (e.g. like a rubber band) to fit into the groove 150 around the mat 26 and thereafter elastically biased against the inside wall 152 of the groove 150 in gripping, liquid-tight sealing engagement. However, the present disclosure is not limited to this arrangement for coupling and sealing the seal member 118 to the mat 26. Any other suitable arrangement may be used. For example, the seal member 118 may be glued, press or snap fit into the groove 150 or other portion of the mat 26, mateably engaged with the mat 26, or coupled to the mat 26 with clips or other mechanical connectors.

Still referring to the embodiment of FIG. 7B, the bottom side 124 of the exemplary seal member 118 includes an elongated base 128 which seats within the groove 150. If desired, referring to FIGS. 10A-B, the width W1 and length L1 of the base 128 may be sized to mate with or fit within the groove 150. For example, the width W1 and length L1 of the base 128 may be the same size, smaller or larger than the height H1 and depth D1 of the groove 150, respectively. In the present embodiment, the width W1 and length L1 of the seal member 118 is substantially the same as, or identical to, the height H1 and depth D1 of the groove 150. In some embodiments, the seal member 118 may be removable from the groove 150 and replaced as needed.

If desired, one or more sealing or bonding agent, or other material, may be included to assist in providing a liquid-tight seal between each seal member 118 and its corresponding mat 26. For example, such agent(s) and/or material(s) may be provided in the groove 150 and/or on edge 44 of the mat 26 adjacent to the groove 150 to assist in providing sealing engagement with the seal member 118. Any suitable sealant, such as silicone glue, may be used. For another example, fibrous absorbent may also or instead be used. Suitable fibrous absorbents may include any combination of "renewable" fibrous natural material, such as one or more among cotton, sisal, kapok, agave/henequen, abaca/manila hemp, palmetto, flax/linen, hemp/burlap, jute, ramie, kenaf, coir, wool, cellulose fibers or the like, as well as synthetic, man-made or non-fibrous materials. In some embodiments, kenaf may be a preferred fibrous absorbent.

Each seal member 118 may extend into the associated gap 22 (e.g. FIGS. 5B, 7B) and sealingly engage an opposing seal member 118 in any suitable manner. In the present embodiment, referring to FIGS. 8A-D, the top side 122 of each seal member 118 includes an elongated body 132 extending outwardly from the base 128 and configured to extend into the associated gap 22 (e.g. FIG. 5B) formed between adjacent mats 26. The body 132 may have any suitable form, configuration and operation. In this example, the body 132 includes an elongated front wall 134 having an elongated face 136 at its front end 138, and an elongated rear wall 140 from which the base 128 extends rearwards. The exemplary face 136 sealingly engages the corresponding face 136 of the opposing seal member 118. Thus, when the adjacent illustrated seal members 118 (FIGS. 5B, 7B) extend into the gap 22, the faces 136 of the bodies 132 thereof abut one another and form a liquid tight seal. In some embodiments, the faces 136 may be configured to mate one another, such as with mating tongues/grooves (or other suitable mating features) formed therein. However, the seal member 118 may include multiple sealing faces or other portions configured to sealingly engage one another or another component.

Referring back to the embodiment of FIG. 5B, if desired, the exemplary seal members 118 may flex, bend, deform or move in the gaps 22 to accommodate geometric changes, expansion, compression, movement or displacement of one or both mats 26*a*, 26*b* or the load-supporting surface 16 during normal operating conditions as necessary to assist in providing and maintaining sealing engagement of the faces 136 (or other portions) thereof in the gap 22. Thus, as the geometry of the gap 22 changes, the illustrated seal members 118 respond as necessary. For example, the body 132 may include one or more features designed to assist in providing and maintaining sealing engagement of the faces 136 in the gap 22. In the illustrated embodiment, the width W2 (FIG. 10B) of the body 132 of each seal member 118 is greater than half the known, or expected, width W3 (FIG. 5B) of the gap 22. In such instance, when the mats 26*a*, 26*b* are connected in the load-supporting surface 16, the combined width (W2×2) of the adjacent seal members 118*a*, 118*b* is greater than the width W3 of the gap 22, encouraging liquid-tight sealing contact between the seal members 118.

Figure 8D:
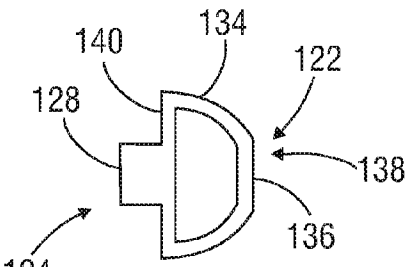
FIG. 8D is an end view of the exemplary seal member of FIG. 8A.
Figure 8C:
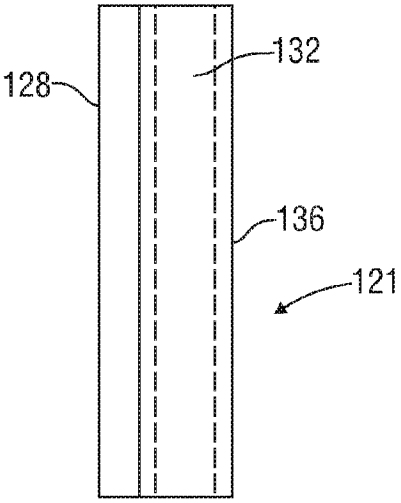
FIG. 8C is an side view of the exemplary seal member of FIG. 8A.
Figure 8B:
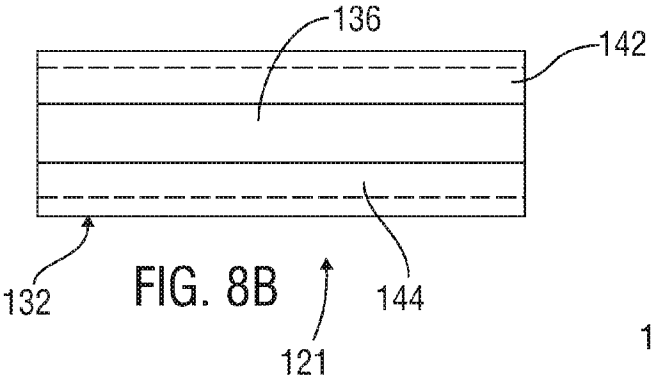
FIG. 8B is a top view of the exemplary seal member of FIG. 8A.
Figure 8A:
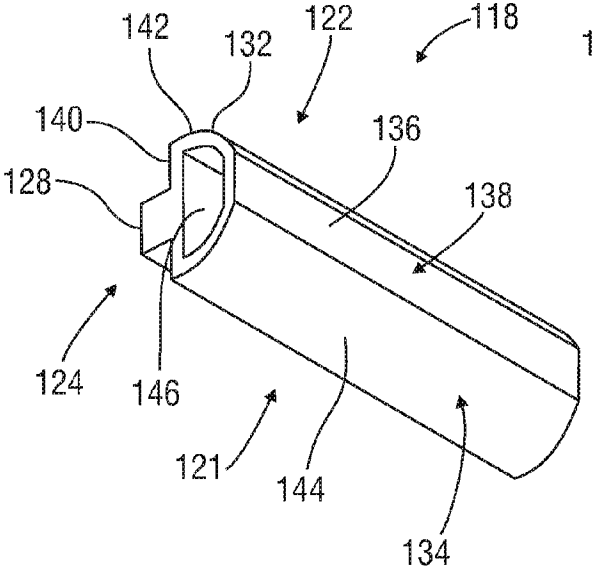
FIG. 8A is a perspective view of a liner section of an exemplary frame style seal member in accordance with an embodiment of the present disclosure.
Figure 9B:
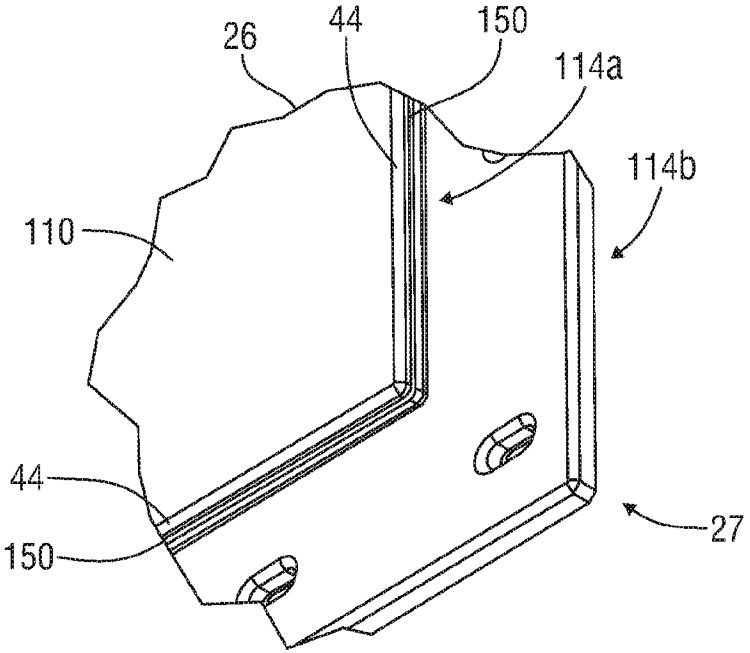
FIG. 9B is an exploded view the exemplary mat of FIG. 9A taken from inside the circle in FIG. 9A labeled "FIG. 9B"
Figure 9A:
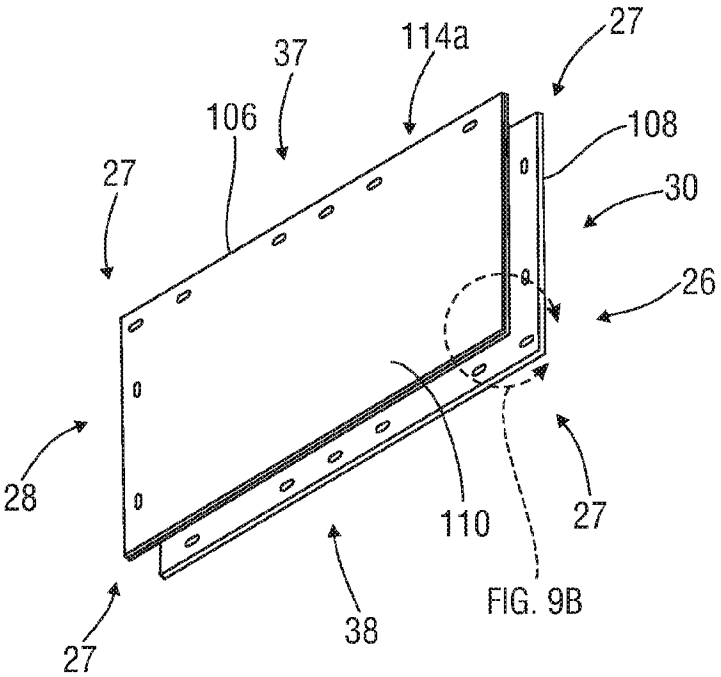
FIG. 9A is a perspective view of an exemplary mat of the type shown in FIG. 2 having an embodiment of a frame style seal engagement groove formed in an outer edge thereof and extending around the perimeter thereof in accordance with an embodiment of the present disclosure.
Figure 10A:
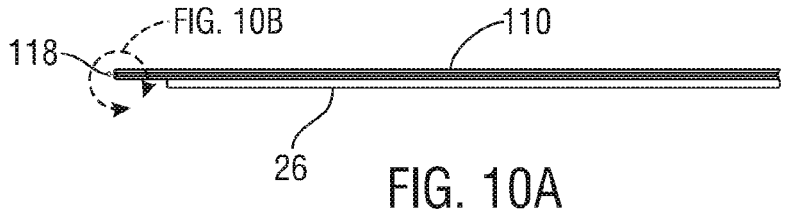
FIG. 10A is a side view of part of an exemplary mat of the type shown in FIG. 2 and components of an exemplary frame style seal assembly in accordance with an embodiment of the present disclosure.
Figure 10B:
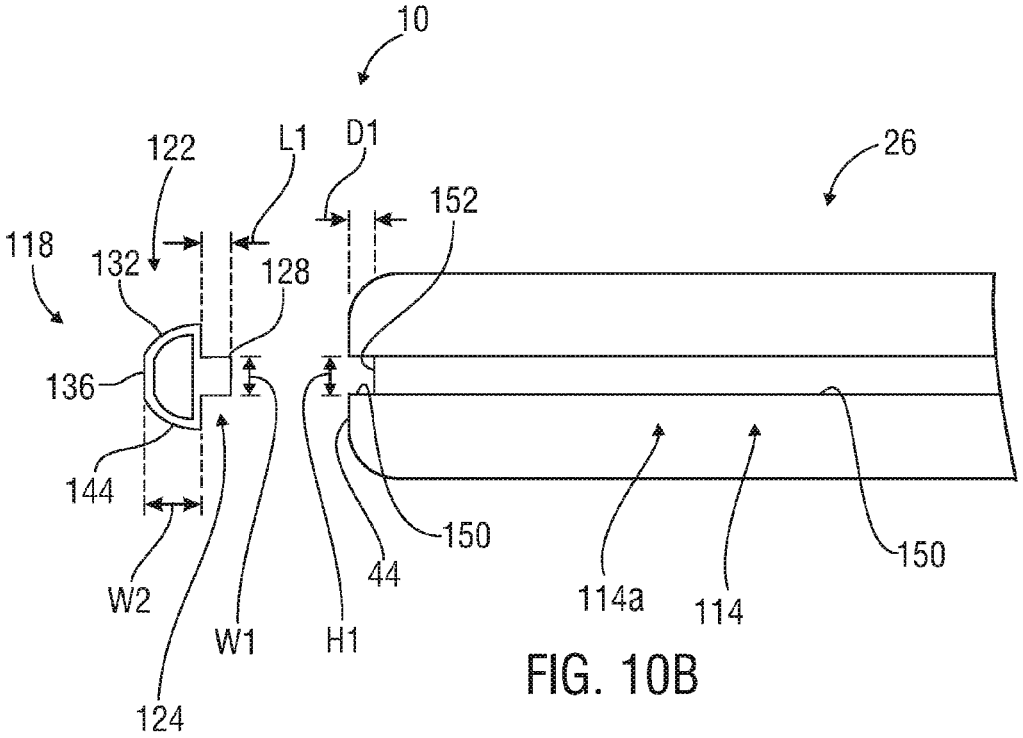
FIG. 10B is an exploded view of part of the exemplary mat and components of the exemplary frame style seal assembly of FIG. 10A.
Figure 11:
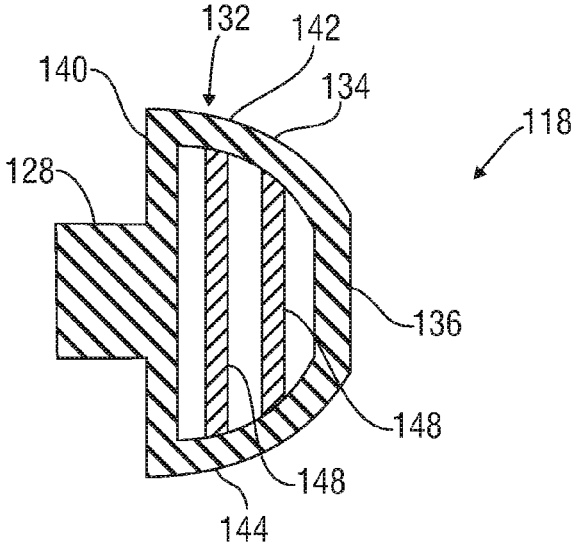
FIG. 11 is a cross-sectional view of an exemplary frame style seal member in accordance with an embodiment of the present disclosure.
Figure 12A:
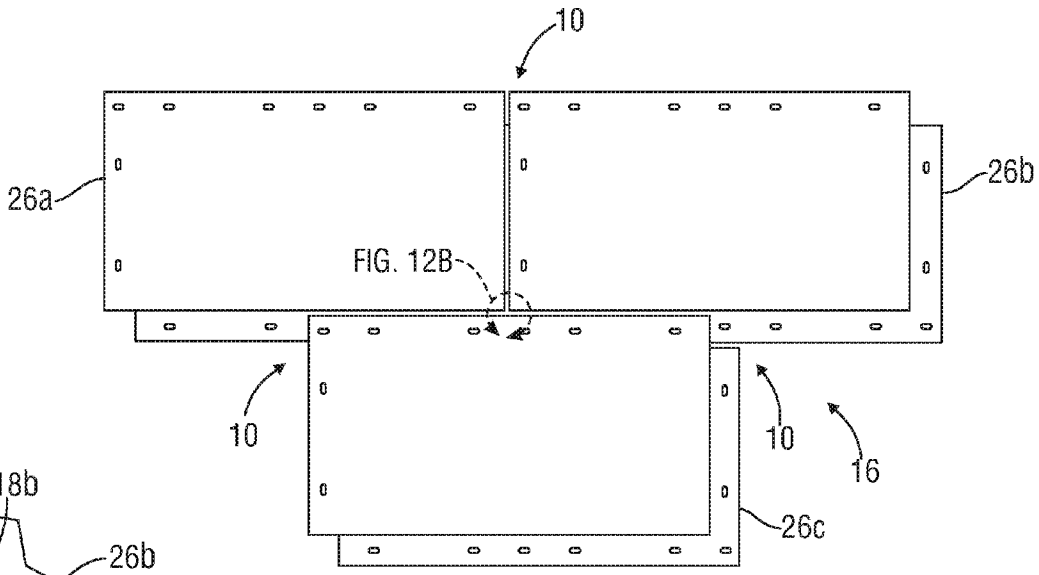
FIG. 12A is a top view of three exemplary mats of the type shown in FIG. 2 and components of an exemplary frame style seal assembly in accordance with an embodiment of the present disclosure.
Figure 13A:
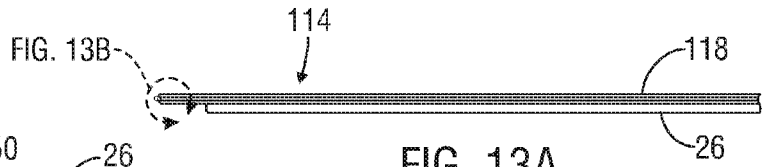
FIG. 13A is a side view of part of an exemplary mat of the type shown in FIG. 2 engaged with an exemplary frame style seal member in accordance with an embodiment of the present disclosure.
Figure 13B:
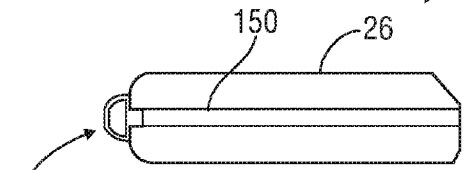
FIG. 13B is an exploded view the exemplary mats of FIG. 13A taken from inside the circle in FIG. 13A labeled "FIG. 13B" and positioned to be joined together.
Figure 12B:
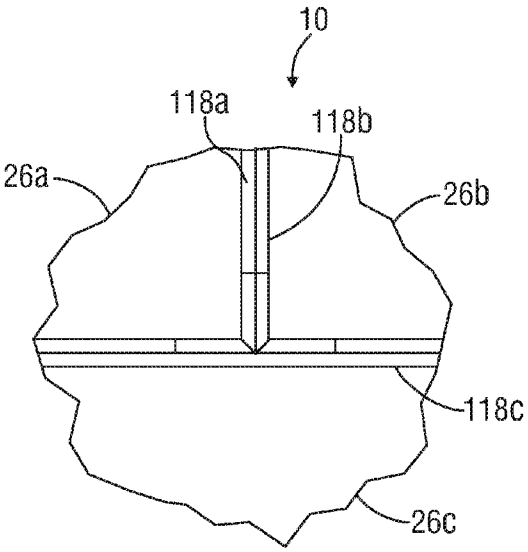
FIG. 12B is an exploded view the exemplary mats of FIG. 12A taken from inside the circle in FIG. 12A labeled "FIG. 12B" and positioned to be joined together.

For another example, referring to the embodiment of FIG. 8A, the body 132 may include one or more features designed to provide a desired degree of flexibility, elasticity, rigidity and/or stiffness depending upon the particular use scenario. The illustrated exemplary body 132 has curved upper and lower sections 142, 144, such as to allow sufficient bending of the body 132 as becomes necessary to maintain sealing engagement of the faces 136. In some embodiments, the upper and lower sections 142, 144 may bow up or down and/or in or out, and/or may abut the sections 142, 144 of adjacent seal members 118.

Still referring to FIG. 8A, for a further example, the illustrated body 132 also includes an elongated cavity 146, such as to allow flexibility of the seal member 118 and/or compliance with movement of the adjacent mat(s) 26 and load-supporting surface 16, and assist in maintaining sealing engagement between the seal members 118. If desired, one or more ribs 148 (e.g. FIG. 11) may extend into or through the cavity 146 to increase stiffness or rigidity. The ribs 148 may have any desired form, configuration, construction, operation and positioning. In this example, two rubber ribs 148 are shown extending between the upper and lower sections 142, 144 of the body 132. However, one or more ribs may also or instead extend between, or from, any other portions of the seal member 118.

Still referring to FIG. 8A, for still a further example, the front wall 134 of the body 132 may, if desired, be formed with a particular thickness that allows the desired flexibility/rigidity of the body 132. For example, in some applications the front wall 134 may have a thickness of between 0.095" and 0.100".

If desired, each seal member 118, or any desired portions thereof, may be constructed of one or more flexible, pliable or bendable materials to allow the desired level of elasticity for sealing engagement with its corresponding mat 26 and to maintain a liquid tight seal with adjacent seal members 118. Any suitable material may be used. For example, in some applications, the seal member 118 may be constructed of a neoprene-buna rubber blend.

The seal member 118 may be one integral component, or formed of multiple components interconnected in any suitable manner. In the present embodiment, referring to FIGS. 14A-D, the seal member 118 includes multiple linear sections 121 and multiple corner sections 119 that are vulcanized together to form the unitary seal member 118 (See also FIGS. 17A-B). In other embodiments, multiple components of the seal member 118 may be interconnected with the use of heavy duty adhesive, heat-activated glue, mechanical fasteners, etc.

Figure 19A:
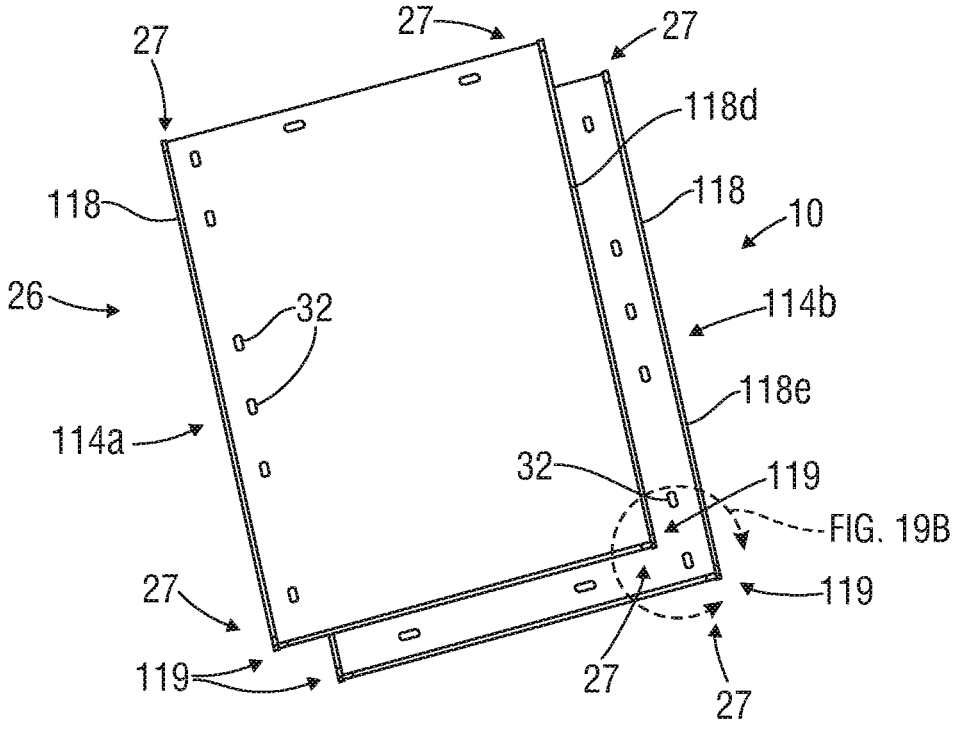
FIG. 19A is a top view of an exemplary mat of the type shown in FIG. 2 having exemplary frame style seal members shown extending around first and second perimeters thereof and exemplary corner fillers in accordance with an embodiment of the present disclosure.
Figure 19B:
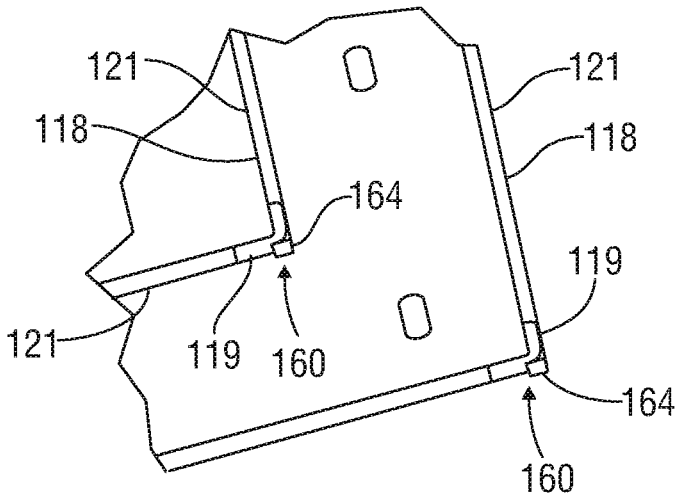
FIG. 19B is an exploded view of part of the exemplary mat of FIG. 19A taken from inside the circle in FIG. 19A labeled "FIG. 19B"
Figure 20A:
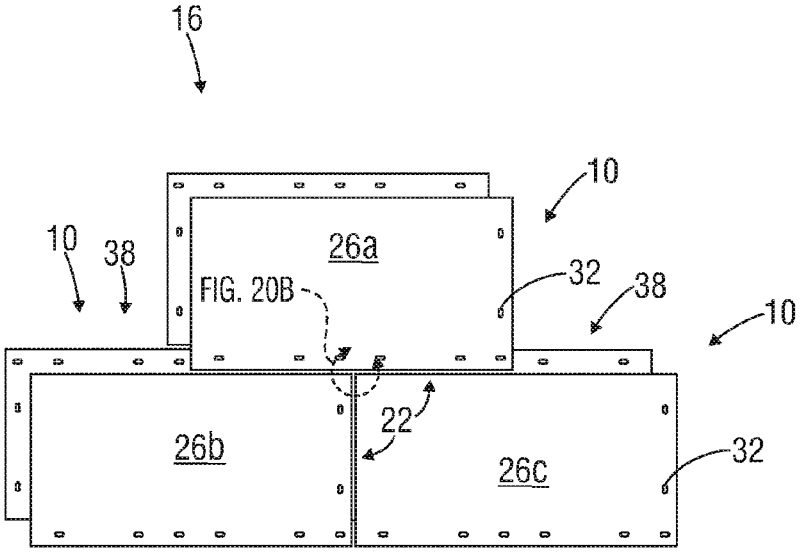
FIG. 20A is a top view of three exemplary mats of the type shown in FIG. 2 having components of an exemplary frame style seal assembly in accordance with an embodiment of the present disclosure.
Figure 20B:
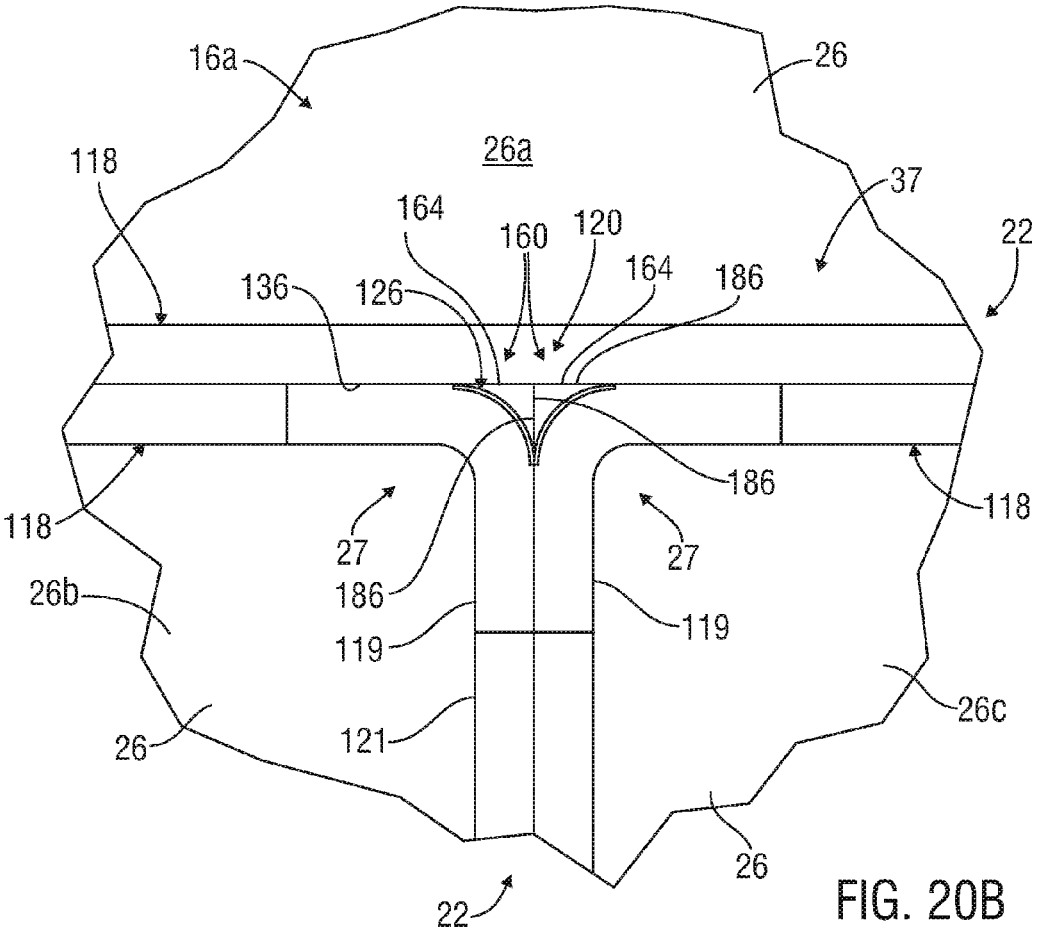
FIG. 20B is an exploded view of the intersection of the three exemplary mats of FIG. 20A taken from inside the circle in FIG. 20A labeled "FIG. 20B"

If desired, referring to FIGS. 19A & 19B, the seal assembly 10 may include one or more corner filler 160 positionable at one or more corners 27 of the mat 26. The corner filler 160 may be useful in some embodiments, for example, to fill in portions of intersecting gaps 22 (e.g. FIGS. 20A-B) between adjacent mats 26 that may not be completely filled by the respective adjacent seal members 118. For another example, the corner filler 160 may be useful in some applications to help prevent the seal member 118 from crimping, bulging or otherwise deforming when engaged with a mat 26 or other component is a load-supporting surface 16, which could lead to leakage or loss of sealing engagement. Referring to FIGS. 20A & B, for example, in some applications, one or more portions of the adjacent gaps 22 formed at the intersection of one or more corners 27 of one or two mats 26*b*, 26*c* and a side of a third mat 26*a* (see also intersection 60 in FIG. 1) may not be completely filled by the corresponding seal members 118. This may occur, for example, due to the shape, curvature, flexibility or other feature of the seal members 118 at their corners 119. In this example, the illustrated gap 22 is formed at the corners 27 of mats 26*b*, 26*c* and the side 37 of mat 26*a*. However, in other arrangements, one or more corners 27 of one or more mats 26 may intersect with one or more other sides 28, 30 or 38 (e.g. FIGS. 2 & 3) of one or more other mats 26 or components of the load-supporting surface 16.

Figure 21B:
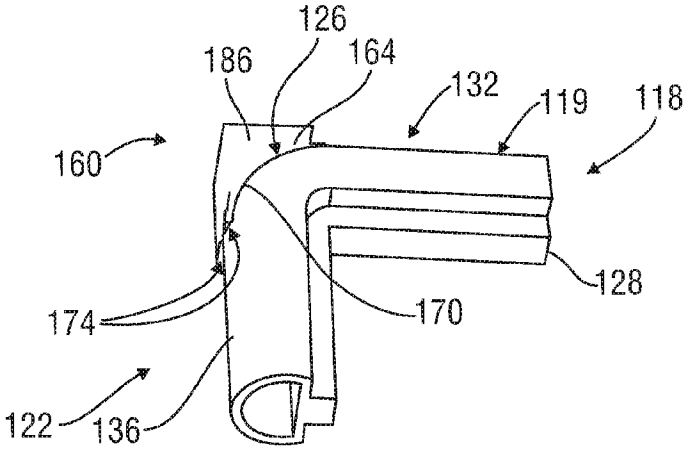
FIG. 21B is a perspective view of the exemplary corner filler of FIG. 21A.
Figure 21C:
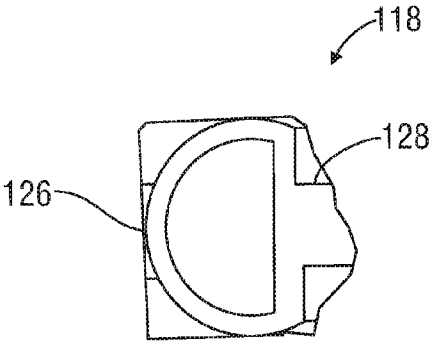
FIG. 21C is a cut-away end view of the exemplary corner filler of FIG. 21A.
Figure 21A:
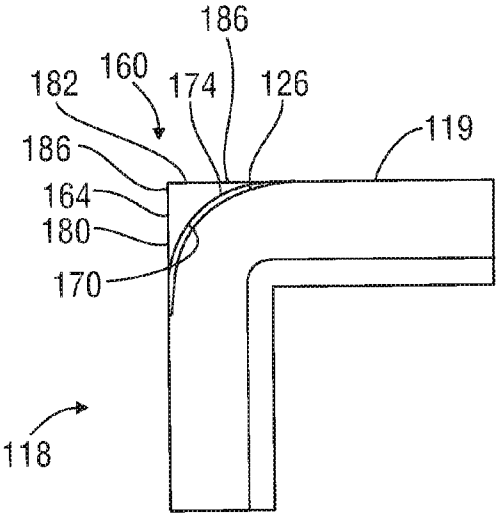
FIG. 21A is a top view of an exemplary corner filler in accordance with an embodiment of the present disclosure.

The corner filler 160 may have any suitable form, configuration and operation. In the embodiment of FIGS. 19A-21C, the corner filler 160 is a wedge 164 extending from the seal member 118. As shown in FIGS. 21A-C, the corner section 119 of the illustrated seal member 118 has a curved outer shape forming a bulb 126. The exemplary wedge 164 is shaped to effectively fill in sufficient space around the bulb 126 of the seal member 118 to form an approximate or perfect right angle. In other embodiments, the wedge 164 may not be shaped to form an approximate or perfect right angle around the bulb 126, but have any other suitable shape to provide sufficient liquid-tight sealing engagement between the associated seal member 118 (when coupled to a mat 26) and at least one seal member 118 of at least one adjacent mat 26 or other component of a load-supporting surface 16.

The illustrated wedge 164 is integral with the seal member 118. In this embodiment, the exemplary seal member 118 and wedges 164 are formed with the use of pre-formed molds used in an injection molding process, as is and becomes further known in the art. However, any other desired equipment and processes may be used to form the seal member 118 and/or corner fillers 160, such as with pre-formed molds useful in other molding processes (e.g. thermoplastic compression or rotational molding) or casting processes, as is and becomes further known in the art. In yet other embodiments, the seal member 118 and wedges 164 (or other corner fillers 160) may be formed in an extrusion process with the use of one or more extruders, as is and becomes further known in the art. In yet other embodiments, the wedge 164 (or other corner filler 160) may be a separate component that is coupled to the seal member 118, such as with the use of heavy duty adhesive, heat-activated glue, mechanical fasteners, etc. In yet other embodiments, the fillers 160 may not be coupled to the seal member 118.

Referring still to FIGS. 21A-C, the exemplary wedge 164 has a generally triangular outer shape with a hypotenuse, or long, side 170 that is curved. The curved shape of the illustrated long side 170 may be provided, for example, to seat, contact or mate with the outer curvature of the bulb 126 when the seal member 118 is engaged with a mat 26 in a load-supporting surface 16. In other embodiments, the long side 170 may not be curved. The other sides 180, 182 of the exemplary wedge 164 each have an outer face 186 that sealingly engages the adjacent face 186 of the wedge 164 of one or more adjacent seal member 118, the corresponding face 136 of another portion of one or more adjacent seal member 118 (see e.g. FIG. 20B), one or more other component, or a combination thereof.

If desired, referring to FIG. 21A, one or more space 174 may be formed between the bulb 126 of the corner section 119 and the long side 170 of the wedge 164. The space 174 may be provided for example, to give room for the bulb 126 and/or the wedge 164 to compress, shift, or fit snugly with one another when engaged with a mat 26 in a load-supporting surface 16 and/or to help fill the gap 22 between adjacent mats 26. (See e.g. FIG. 20B). As best shown in FIG. 21B, in the illustrated embodiment, the wedge 164 is engaged with, or molded to, the bulb 126 at, near or along a centerline of the face 136 of the body 132 of the bulb 126, forming a space 174 along each side of the bulb 126. Thus, the illustrated seal member 118 includes two spaces 174 between each bulb 126 and associated wedge 164.

Referring again to FIG. 5B, an exemplary method of use of the illustrated frame style seal assembly 10 in a load-supporting surface 16 having multiple mats 26 will now be described. In this example, at least one seal member 118 is coupled to each mat 26 and arranged and adapted to extend laterally outwardly from the mat 26 along at least one side 28, 30, 37, 38 thereof. For example, a groove 150 may be formed in the aligned edges 44 (FIG. 7B) of each mat 26 around its perimeter 114*a* and the corresponding seal member 118 secured therein. In some applications, sealant may be placed between each seal member 118 and its respective mat 26.

In the present embodiment, the seal member 118 is elastically-biased into the grooves 150 extending around the perimeter 114*a*. The illustrated mats 26 are then interconnected in the load-supporting surface 16, forming gaps 22 between adjacent mats 26. Each exemplary seal member 118 extends into a gap 22 and abuts the opposing seal member(s) 118 extending from one or more adjacent mats 26. For example, the body 132 of each seal member 118 may include a face 136 (FIG. 7B) that abuts and sealing engages the face 136 of the body 132 of each opposing seal member 118. Thereafter, during normal operating conditions, each illustrated seal member 118 remains coupled to and moves along with its respective mat 26 while remaining sealingly engaged with the opposing seal members 118 in the gaps 22 around the perimeter 114*a* of its mat 26 to provide a liquid-tight seal across or through the associated gaps 22 in the load-supporting surface 16. In use of the exemplary frame style seal assembly 10, each seal member 118 is designed to respond to movement of its connected mat 26 without losing its connection to and sealing engagement therewith and its sealing engagement with each corresponding opposing sealing member 118 in the gaps 22 around the mat 26. The same exemplary methods of use apply equally to embodiments in which one or more seal member 118 are also or instead provided around the lower perimeter 114*b* of the mat 26, such as the embodiments of FIGS. 17A-19B.

While the frame style seal assembly 10 is described herein as being used across or through gaps 22 formed between adjacent mats 26, it may be used similarly as described above between mats 26 and other components associated with a load-supporting surface 16, or between the other components themselves. Some potential additional components that may be useful in connection with load-supporting surfaces 16, such as berm members, spacers, drive-over barriers, liquid drain assemblies, electrically conductive covers, etc., are shown and disclosed in U.S. Pat. No. 9,039,325 B2 to McDowell, entitled "Liquid Containment System for Use With Load-Supporting Surfaces" and issued on May 26, 2015, U.S. patent application Ser. No. 14/720,799, entitled "Liquid Containment System" and filed on May 24, 2015, U.S. patent application Ser. No. 14/496,105, entitled "Apparatus & Methods for Electrically Grounding a Load-Supporting Surfaces" and filed on Sep. 25, 2014, all of which have a common Assignee as the present patent application and the entire contents of which are hereby incorporated by reference herein in its entirety.

Figure 16:
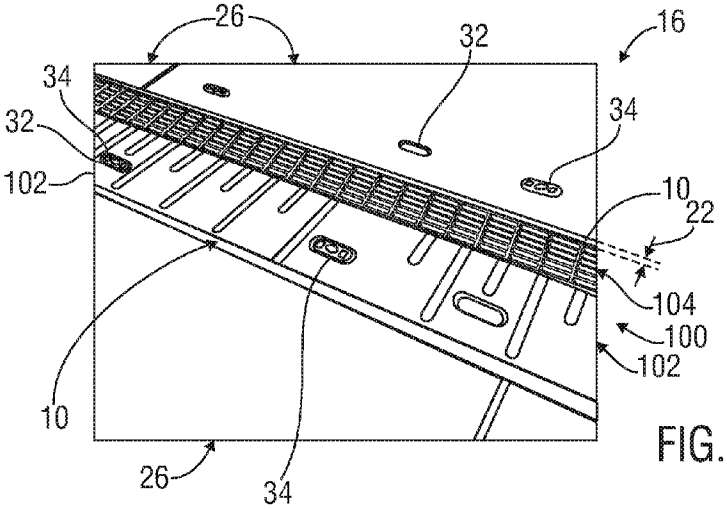
FIG. 16 is a top view of an exemplary load-supporting surface having an exemplary frame style seal assembly secured between a liquid drain assembly and adjacent mats in accordance with an embodiment of the present disclosure.

For example, in the embodiment of FIG. 16, a frame style seal assembly 10 is shown engaged in gaps 22 formed between a liquid drain assembly 100 and mats 26 of the illustrated load-supporting surface 16. The illustrated liquid drain assembly 100 includes a pair of elongated, axially-aligned drain channels 102 such as described in U.S. Pat. No. 9,039,325 B2 and U.S. patent application Ser. No. 14/720,799. Each exemplary drain channel 102 includes at least one elongated fluid flow passageway (not shown) that allows controlled drainage of liquid off of the load-supporting surface 16. In this example, the passageways are covered with a load bearing cover 104 useful to allow people, vehicles (not shown) or other equipment or structures to move across the load-supporting surface 16 or be placed atop the drain channel 102, such as described in U.S. Pat. No. 9,039,325 B2 and U.S. patent application Ser. No. 14/720,799. The illustrated drain channels 102 also include locking pin holes 32 through which locking pins 34 are engageable for connection with adjacent mats 26.

Accordingly, in many embodiments, the frame style seal assembly 10 may be used in a load-supporting surface 16 to create a positive liquid impermeable seal across, over or through the gaps 22 between mats 26 and/or other components. In various applications, the seal assembly 10 may be useful, for example, to prevent liquid from entering or leaking through one or more gaps 22, to prevent the leakage of liquid from atop or between adjacent mats 26 and/or other components onto the ground 20 or other underlying surface or area, or other suitable purpose, all without the need for liners (not shown) underneath the load-supporting surface 16. If desired, however, liners can still be used in many applications, such as, as a backup spill-management component. Thus, the present disclosure does not necessarily disallow the use of liners. The load-supporting surface 16 may be designed to be functional in varied operating conditions, including bearing the weight of vehicles, equipment and personnel thereupon and moving thereacross and environmental factors such as heat, cold, temperature changes, rain, snow, etc. The conditions that are expected in a particular use scenario and within which the load-supporting surface 16 is expected to function are referred to herein as "normal operating conditions" or variations thereof.

If desired, the seal assembly 10 may be part of a spill management system to prevent liquid leakage from one or more permanent, semi-permanent or temporary load-supporting surface 16 and facilitate clean-up or disposal of such liquid. For example, the seal members 10 may be used in conjunction with technology shown and disclosed in any combination of U.S. patent application Ser. No. 14/497,429, filed on Sep. 26, 2014 and entitled "Apparatus & Methods for Sealing Around the Opening to an Underground Borehole", U.S. patent application Ser. No. 14/666,584, filed on Mar. 24, 2015 and entitled "Apparatus & Methods for Mechanically Coupling a Sealing System Around the Opening to an Underground Borehole", U.S. patent application Ser. No. 13/803,580, filed on Mar. 14, 2013 and entitled "Apparatus and Methods for Sealing Between Adjacent Components of a Load-Supporting Surface", U.S. Provisional Patent Application Ser. No. 62/013,899, filed on Jun. 18, 2014 and entitled "Load-Supporting Surface with Interconnecting Components and Top Side Seal Assembly for Sealing Therebetween and Methods of Assembly and Use Thereof", and U.S. patent application Ser. No. 14/730,938, filed on Jun. 4, 2015 and entitled "Load-Supporting Surface with Actively Connected Gap Seals and Related Apparatus and Methods", all of which have a common Assignee as the present application and the entire contents of which are hereby incorporated by reference herein, U.S. Pat. Nos. 5,653,551, 6,511,257, 9,039,325 and U.S. patent application Ser. Nos. 13/780,350 and 14/720,799, and all other patents and patent applications mentioned elsewhere herein, such as to provide a self-contained liquid barrier system around and across the load-supporting surface 16 without the need for any liners below or adjacent to the load-supporting surface 16.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components. While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. Method of manufacturing a plurality of mats useful with a plurality of frame style seal members in a load-supporting surface, each frame style seal member having front and rear portions and being configured to be coupled to one of the mats and provide a liquid-tight seal across a gap formed between adjacent mats in the load-supporting surface, the method comprising:

at least one milling machine or router forming a first elongated groove in a first outer edge of at least a first side of each among at least first and second stepped-configuration, reversible mats, the first outer edge of each mat extending at least partially around a first perimeter of the mat, the first elongated groove of each mat being configured to seat the rear portion of at least one frame style seal member, each mat being useful at an outdoor worksite and configured to support the weight of people, vehicles and equipment thereupon;

at least one milling machine or router forming a second elongated groove in a second outer edge of at least the first side at least the first and second mats, the second outer edge of each mat extending at least partially around second perimeter of the mat, wherein the first and second outer edges of each mat are offset relative to one another depth-wise so that the first outer edge on at least the first side of each mat is disposed above and outwards of the second outer edge on at least the first side of each mat when the mat is right-side-up, the second elongated groove of each mat being configured to seat the rear portion of at least one other frame style seal member; and each among the first and second grooves of at least the first side of at least first and second mats causing the front portions of the frame style seal members seated therein to extend into a respective gap formed between the first and second mats when the first and second mats are positioned adjacent to one another in the load-supporting surface with the first mat right-side-up and the second mat upside-down, abut at least one frame style seal member seated in the first or second groove of the first side of the adjacent mat and form a liquid-tight seal therewith across the corresponding gap.

2. Method of manufacturing a plurality of mats useful with a plurality of frame style seal members in a load-supporting surface, each frame style seal member having front and rear portions and being configured to be coupled to one of the mats and provide a liquid-tight seal across a gap formed between adjacent mats in the load-supporting surface, the method comprising:

at least one pre-formed mold forming a first elongated groove in a first outer edge of at least a first side of each among at least first and second stepped-configuration, reversible mats, the first outer edge of each mat extending at least partially around a first perimeter of the mat, the first elongated groove of each mat being configured to seat the rear portion of at least one frame style seal member, each mat being constructed at least partially of thermoplastic material, useful at an outdoor worksite and configured to support the weight of people, vehicles and equipment thereupon;

at least one pre-formed mold forming a second elongated groove in a second outer edge of at least the first side at least the first and second mats, the second outer edge of each mat extending at least partially around second perimeter of the mat, wherein the first and second outer edges of each mat are offset relative to one another depth-wise so that the first outer edge on at least the first side of each mat is disposed above and outwards of the second outer edge on at least the first side of each mat when the mat is right-side-up, the second elongated groove of each mat being configured to seat the rear portion of at least one other frame style seal member; and each among the first and second grooves of at least the first side of at least first and second mats causing the front portion of the frame style seal member(s) seated therein to extend into a respective gap formed between the first and second mats when the first and second mats are positioned adjacent to one another in the load-supporting surface with the first mat right-side-up and the second mat upside-down, abut at least one frame style seal member seated in the first or second groove of the first side of the adjacent mat and form a liquid-tight seal therewith across the corresponding gap.

* * * * *